US006715852B2

(12) United States Patent
Yonekubo

(10) Patent No.: US 6,715,852 B2
(45) Date of Patent: Apr. 6, 2004

(54) LIQUID JETTING APPARATUS

(75) Inventor: Shuji Yonekubo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/817,755

(22) Filed: Mar. 27, 2001

(65) Prior Publication Data

US 2002/0012017 A1 Jan. 31, 2002

(30) Foreign Application Priority Data

Mar. 27, 2000 (JP) ..... 2000-086443
Mar. 27, 2000 (JP) ..... 2000-086889

(51) Int. Cl.[7] ..... B41J 29/38
(52) U.S. Cl. ..... 347/10; 347/11
(58) Field of Search ..... 347/9, 10, 11

(56) References Cited

U.S. PATENT DOCUMENTS 6,145,949 A 11/2000 Takahashi
6,281,913 B1 * 8/2001 Webb ..... 347/46
6,328,395 B1 * 12/2001 Kitahara et al. ..... 347/9

FOREIGN PATENT DOCUMENTS

| | | |
|---|---|---|
| EP | 0 788 882 A2 | 8/1997 |
| EP | 0 827 838 A2 | 3/1998 |
| EP | 0 974 464 A2 | 1/2000 |
| EP | 0 979 732 A1 | 2/2000 |
| EP | 1 024 000 A2 | 8/2000 |
| EP | 1 052 097 A2 | 11/2000 |
| EP | 1 080 896 A1 | 3/2001 |
| JP | 10-6526 | 1/1998 |
| JP | 10-81012 | 3/1998 |
| JP | 11-20158 | 1/1999 |
| JP | 11-314360 | 11/1999 |
| JP | 2000-37867 | 2/2000 |

* cited by examiner

*Primary Examiner*—Stephen D. Meier
*Assistant Examiner*—Alfred E Dudding
(74) *Attorney, Agent, or Firm*—Sughrue Mion, PLLC

(57) ABSTRACT

The liquid jetting apparatus includes a head member having a nozzle, and a micro-vibrating unit that can cause liquid in the nozzle to minutely vibrate. A serial-signal generating unit can generate a serial periodical signal. A mode-signal generating unit can generate a mode signal depending on the liquid supplied to the nozzle. A micro-vibrating controlling unit can cause the micro-vibrating unit to operate, based on the serial periodical signal and the mode signal.

67 Claims, 11 Drawing Sheets

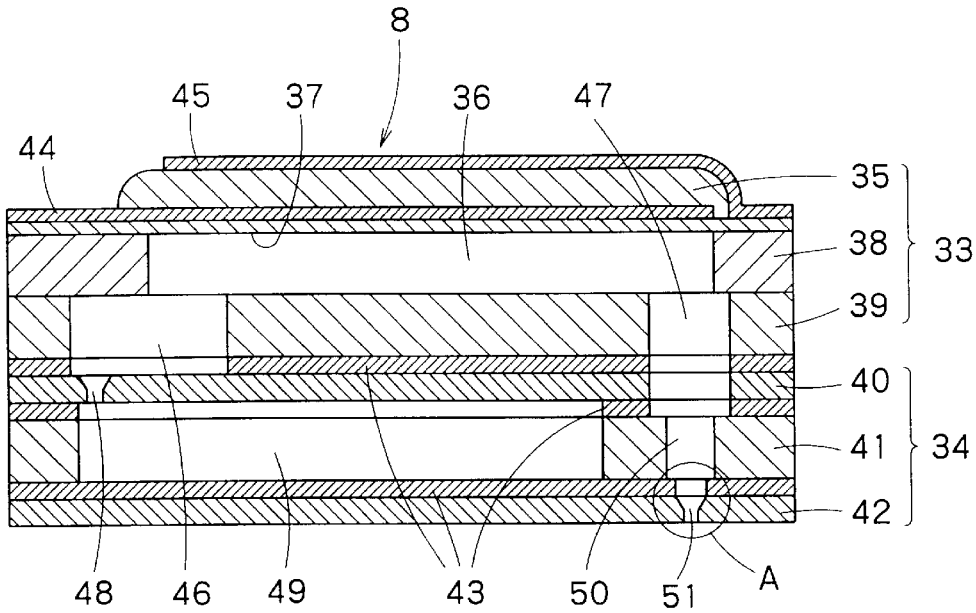
FIG. 5A PRIOR ART
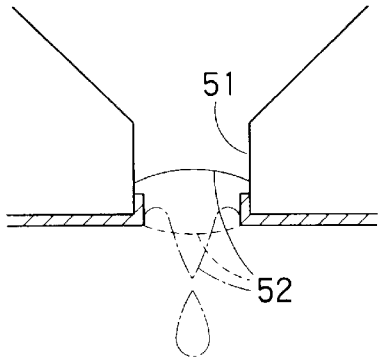
FIG. 5B

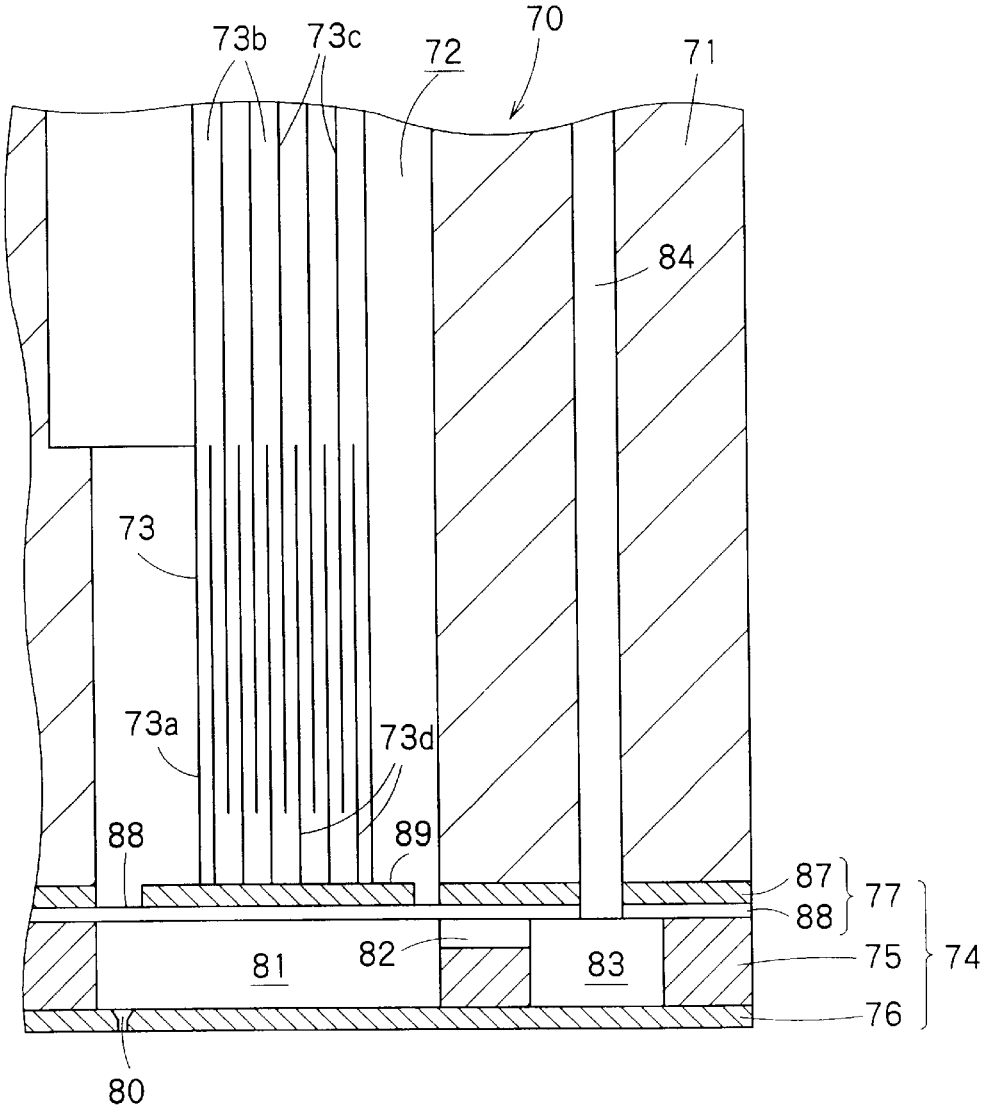
F I G. 10 PRIOR ART

LIQUID JETTING APPARATUS

FIELD OF THE INVENTION

This invention relates to a liquid jetting apparatus having a head member capable of jetting liquid from nozzles, such as an ink-jet recording apparatus having a recording head capable of jetting ink from nozzles to form dots on a recording medium. In particular, this invention is related to a liquid jetting apparatus which can prevent viscosity of liquid in nozzles from increasing.

BACKGROUND OF THE INVENTION

An ink-jet recording apparatus such as an ink-jet printer or an ink-jet plotter has a recording head that is movable along a main scanning direction. The recording head has nozzles capable of jetting ink. For example, the nozzles are communicated to pressure chambers which can expand and contract respectively. In the case, the ink in the nozzles can be jetted by expanding and contracting of the pressure chambers.

On the other hand, the ink-jet recording apparatus is adapted to feed a recording medium such as a paper along a subordinate scanning direction, which is perpendicular to the main scanning direction. Thus, the nozzles of the recording head can jet ink to form an image or a character on the recording medium in cooperation with moving the recording head and the recording medium according to recording data.

The ink in the nozzles of the recording head is exposed to air. Thus, solvent of the ink such as water may gradually evaporate to increase a viscosity of the ink in the nozzles. In the case, quality of printed (recorded) images may deteriorate because the ink having a great viscosity may be jetted toward a direction deviated from a normal direction.

To prevent the viscosity of the ink in the nozzles from increasing, some measures have been proposed. One of the measures is to cause a meniscus of the ink to minutely vibrate to stir the ink. The meniscus means a free surface of the ink exposed at an opening of the nozzle.

For stirring the ink, the meniscus may be vibrated to a jetting direction of the ink and to a contracting direction opposed to the jetting direction by turns in such a manner that the ink may not be jetted. The vibration of the meniscus can be also carried out by expanding and contracting of the pressure chambers. Owing to the vibration of the meniscus, the ink at the opening of the nozzle may be stirred to prevent the viscosity of the ink from increasing.

The stirring of the ink may be carried out during a recording operation. For example, the stirring may be carried out while a carriage carrying the recording head is being accelerated after starting a main scanning, or while a recording operation for a line is being carried out. In the stirring while the carriage is being accelerated, a micro-vibrating operating signal for micro vibrating is supplied to the recording head to cause all menisci in the nozzles to minutely vibrate. In the stirring while the recording operation is being carried out, a pulse signal for micro vibrating is generated from a jetting operating signal for jetting ink, and the pulse signal is supplied to the recording head. Thus, the ink in the nozzles not in the recording (jetting) operation may be stirred.

In addition, Japanese Patent Laid-Open Publication No. 2000-21507 has described that it is effective to cause menisci of ink in nozzles to minutely vibrate during a predetermined time from a suitable timing just before jetting a drop of the ink or from a suitable timing just before jetting a drop of the ink till another suitable timing just before jetting a drop of the ink.

In the conventional ink-jet recording apparatus, micro-vibrating operating signal (including a mid-recording micro-vibrating pulse) supplied to the recording head is constant, independently of a characteristic and/or a kind of the ink. Thus, if a micro-vibrating operating signal is set suitably for ink whose viscosity tends to increase, some problems may arise at nozzles for jetting ink whose viscosity tends not to increase when micro-vibrating operations are performed according to the micro-vibrating operating signal. For example, the nozzles may drip with the ink so that the ink may not be jetted from the nozzles accurately but deflected.

In order to generate a plurality of micro-vibrating signals corresponding to a plurality of characteristics, kinds or states of ink, there is a simple way to provide a plurality of signal-generating circuits. However, the way is not suitable in view of miniaturizing the ink-jet recording apparatus.

SUMMARY OF THE INVENTION

The object of this invention is to solve the above problems, that is, to provide a liquid jetting apparatus having a head member capable of jetting liquid from nozzle that can suitable micro-vibrating operations correspondingly to respective characteristics, kinds or states of liquid, such as an ink-jet recording apparatus that can perform suitable micro-vibrating operations correspondingly to respective characteristics, kinds or states of ink.

In order to achieve the object, the invention is a liquid jetting apparatus comprising: a head member having a nozzle, a micro-vibrating unit that can cause liquid in the nozzle to minutely vibrate; a serial-signal generating unit that can generate a serial periodical signal; a mode-signal generating unit that can generate a mode signal depending on the liquid supplied to the nozzle; and a micro-vibrating controlling unit that can cause the micro-vibrating unit to operate, based on the serial periodical signal and the mode signal.

Particularly, the invention is a liquid jetting apparatus comprising: a head member having a nozzle, a micro-vibrating unit that can cause liquid in the nozzle to minutely vibrate; a micro-vibrating-signal generating unit that can generate a common micro-vibrating signal; a micro-vibrating-mode-signal generating unit that can generate a micro-vibrating mode signal depending on the liquid supplied to the nozzle; and a micro-vibrating controlling unit that can cause the micro-vibrating unit to operate, based on the common micro-vibrating signal and the micro-vibrating mode signal.

According to the above feature, since the micro-vibrating controlling unit can cause the micro-vibrating unit to operate based on the common micro-vibrating signal and the micro-vibrating mode signal, even if the common micro-vibrating signal is used, micro-vibrating operations suitable for the liquid can be achieved by generating the micro-vibrating mode signal dependently on the liquid.

For example, the micro-vibrating-mode-signal generating unit may be adapted to generate a micro-vibrating mode signal depending on a rate of increasing viscosity of the liquid supplied to the nozzle. Alternatively, the micro-vibrating-mode-signal generating unit may be adapted to generate a micro-vibrating mode signal depending on temperature of the liquid supplied to the nozzle.

Preferably, the micro-vibrating controlling unit may have: a signal fusing part that can generate a micro-vibrating operating signal being an AND signal of the common micro-vibrating signal and the micro-vibrating mode signal, and a main controlling part that can cause the micro-vibrating unit to operate based on the micro-vibrating operating signal. In the case, a signal processing based on the common micro-vibrating signal and the micro-vibrating mode signal can be achieved more easily.

In addition, preferably, the common micro-vibrating signal is a periodical signal of a period including a predetermined waveform, and the micro-vibrating mode signal is a periodical signal of a same period as the common micro-vibrating signal including a or more predetermined rectangular pulses. In the case, the respective signals can be generated more easily.

In addition, in order to achieve the object, the invention is a liquid jetting apparatus comprising: a head member having a plurality of nozzles, the nozzles being classified into at least first and second classes; a micro-vibrating unit that can cause liquid in a nozzle or nozzles of the first class to minutely vibrate and that can cause liquid in a nozzle or nozzles of the second class to minutely vibrate; a micro-vibrating-signal generating unit that can generate a common micro-vibrating signal; a micro-vibrating-mode-signal generating unit that can generate a first micro-vibrating mode signal depending on the nozzle or nozzles of the first class and that can generate a second micro-vibrating mode signal depending on the nozzle or nozzles of the second class; and a micro-vibrating controlling unit that can cause the micro-vibrating unit to operate, based on the common micro-vibrating signal and the respective micro-vibrating mode signals.

According to the above feature, since the micro-vibrating controlling unit can cause the micro-vibrating unit to operate based on the common micro-vibrating signal and the respective micro-vibrating mode signals, even if the common micro-vibrating signal is used, micro-vibrating operations suitable for the nozzle or nozzles of the respective classes can be achieved by generating the respective micro-vibrating mode signals dependently on the nozzle or nozzles of the respective classes.

For example, if at least one of the classes includes a plurality of nozzles, liquid in the nozzles of the at least one of the classes may have a rate of increasing viscosity. Alternatively, if at least one of the classes includes a plurality of nozzles, liquid in the nozzles of the at least one of the classes may be a same kind.

In the case too, for example, the micro-vibrating-mode-signal generating unit may be adapted to generate the respective micro-vibrating mode signals depending on respective rates of increasing viscosity of liquid supplied to the nozzle or nozzles of the respective classes. Alternatively, for example, the micro-vibrating-mode-signal generating unit may be adapted to generate the respective micro-vibrating mode signal depending on respective temperatures of liquid supplied to the nozzle or nozzles of the respective classes.

In the case too, preferably, the micro-vibrating controlling unit may have: a signal fusing part that can generate respective micro-vibrating operating signals being AND signals of the common micro-vibrating signal and the respective micro-vibrating mode signals, and a main controlling part that can cause the micro-vibrating unit to operate based on the respective micro-vibrating operating signals.

In addition, preferably, the common micro-vibrating signal may be a periodical signal of a period including a predetermined waveform, and each micro-vibrating mode signal is a periodical signal of a same period as the common micro-vibrating signal including a or more predetermined rectangular pulses.

For example, the common micro-vibrating signal may be a periodical signal of a period including a middle trapezoidal pulse and a large trapezoidal pulse, which appear at substantially regular intervals.

Further preferably, the micro-vibrating-signal generating unit may have: a temperature-detecting part that can detect temperature of the head member; a signal-determining part that can determine an amplitude and a waveform of the common micro-vibrating signal, based on the temperature of the head member detected by the temperature-detecting part; and a signal-generating part that can generate the common micro-vibrating signal determined by the signal-determining part.

The liquid may be ink, and the head member may be a recording head.

A computer system can materialize a controlling unit including: micro-vibrating-signal generating unit that can generate a common micro-vibrating signal; a micro-vibrating-mode-signal generating unit that can generate a micro-vibrating mode signal depending on the liquid supplied to the nozzle; and a micro-vibrating controlling unit that can cause the micro-vibrating unit to operate, based on the common micro-vibrating signal and the micro-vibrating mode signal.

Similarly, a computer system can materialize a controlling unit including: micro-vibrating-signal generating unit that can generate a common micro-vibrating signal; a micro-vibrating-mode-signal generating unit that can generate a first micro-vibrating mode signal depending on the nozzle or nozzles of the first class and that can generate a second micro-vibrating mode signal depending on the nozzle or nozzles of the second class; and a micro-vibrating controlling unit that can cause the micro-vibrating unit to operate, based on the common micro-vibrating signal and the respective micro-vibrating mode signals.

This invention includes a storage unit capable of being read by a computer, storing a program for materializing the controlling unit in a computer system.

This invention also includes the program itself for materializing the controlling unit in the computer system.

This invention includes a storage unit capable of being read by a computer, storing a program including a command for controlling a second program executed by a computer system including a computer, the program is executed by the computer system to control the second program to materialize the controlling unit.

This invention also includes the program itself including the command for controlling the second program executed by the computer system including the computer, the program is executed by the computer system to control the second program to materialize the controlling unit.

The storage unit may be not only a substantial object such as a floppy disk or the like, but also a network for transmitting various signals.

In addition, the invention is a liquid jetting apparatus comprising: a head member having a nozzle; a pressure-changing unit that can change a pressure of the liquid in the nozzle; a main-signal generating unit that can generate a jetting-operating signal; a main-mode-signal generating unit that can generate a main mode signal depending on jetting data and the liquid supplied to the nozzle; a signal fusing part that can generate an operating-pulse signal being an AND signal of the jetting-operating signal and the main mode signal; a main controlling part that can cause the pressure-changing unit to operate based on the operating-pulse signal; wherein the jetting-operating signal is a periodical signal of a period including at least two trapezoidal pulses for performing mid-jetting micro-vibrating operations and at least one waveform for jetting a drop of the liquid; and the main mode signal is a periodical signal of a same period as the jetting-operating signal including a or more predetermined rectangular pulses.

According to the feature, since the main mode signal is generated based on the liquid supplied to the nozzle and the operating signal is formed by an AND signal of the jetting-operating signal and the main mode signal, mid-jetting micro-vibrating operations can be suitably achieved correspondingly to respective characteristics, kinds or states of the liquid.

For example, the main-mode-signal generating unit may be adapted to generate a micro-vibrating mode signal depending on a rate of increasing viscosity of the liquid supplied to the nozzle. Alternatively, for example, the main-mode-signal generating unit may be adapted to generate a micro-vibrating mode signal depending on temperature of the liquid supplied to the nozzle.

In addition, the invention is a liquid jetting apparatus comprising: a head member having a plurality of nozzles, the nozzles being classified into at least first and second classes; a pressure-changing unit that can change a pressure of liquid in a nozzle or nozzles of the first class and that can change a pressure of liquid in a nozzle or nozzles of the second class; a main-signal generating unit that can generate a jetting-operating signal; a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class; a signal fusing part that can generate respective operating-pulse signals being AND signals of the jetting-operating signal and the respective main mode signals; and a main controlling part that can cause the pressure-changing unit to operate based on the respective operating-pulse signals; wherein the jetting-operating signal is a periodical signal of a period including at least two trapezoidal pulses for performing mid-jetting micro-vibrating operations and at least one waveform for jetting a drop of the liquid; and each main mode signal is a periodical signal of a same period as the jetting-operating signal including a or more predetermined rectangular pulses.

According to the feature, since the respective main mode signals are generated based on the liquid supplied to the nozzle or nozzles of the respective classes, mid-jetting micro-vibrating operations can be suitably achieved correspondingly to nozzle or nozzles of the respective classes.

For example, if at least one of the classes includes a plurality of nozzles, liquid in the nozzles of the at least one of the classes may have a rate of increasing viscosity. Alternatively, if at least one of the classes includes a plurality of nozzles, liquid in the nozzles of the at least one of the classes may be a same kind.

In the case too, for example, the main-mode-signal generating unit may be adapted to generate the respective micro-vibrating mode signals depending on respective rates of increasing viscosity of the liquid supplied to the nozzle or nozzles of the respective classes. Alternatively, for example, the main-mode-signal generating unit may be adapted to generate the respective micro-vibrating mode signals depending on respective temperatures of the liquid supplied to the nozzle or nozzles of the respective classes.

Preferably, the at least two trapezoidal pulses for performing the mid-jetting micro-vibrating operations may include a middle trapezoidal pulse and a large trapezoidal pulse.

Further preferably, the main-signal generating unit may have: a temperature-detecting part that can detect temperature of the head member; a signal-determining part that can determine an amplitude and a waveform of the jetting-operating signal, based on the temperature of the head member detected by the temperature-detecting part; and a signal-generating part that can generate the jetting-operating signal determined by the signal-determining part.

The liquid may be ink, the head member may be a recording head, and the jetting data may be recording data.

A computer system can materialize a controlling unit including: a main-mode-signal generating unit that can generate a main mode signal depending on jetting data and the liquid supplied to the nozzle; a signal fusing part that can generate an operating-pulse signal being an AND signal of the jetting-operating signal and the main mode signal; a main controlling part that can cause the pressure-changing unit to operate based on the operating-pulse signal.

Similarly, a computer system can materialize a controlling unit including: a main-signal generating unit that can generate a jetting-operating signal; a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class; a signal fusing part that can generate respective operating-pulse signals being AND signals of the jetting-operating signal and the respective main mode signals; and a main controlling part that can cause the pressure-changing unit to operate based on the respective operating-pulse signals.

This invention includes a storage unit capable of being read by a computer, storing a program for materializing the controlling unit in a computer system.

This invention also includes the program itself for materializing the controlling unit in the computer system.

This invention includes a storage unit capable of being read by a computer, storing a program including a command for controlling a second program executed by a computer system including a computer, the program is executed by the computer system to control the second program to materialize the controlling unit.

This invention also includes the program itself including the command for controlling the second program executed by the computer system including the computer, the program is executed by the computer system to control the second program to materialize the controlling unit.

The storage unit may be not only a substantial object such as a floppy disk or the like, but also a network for transmitting various signals.

BRIEF DESCRIPTION OF THE DRAWINGS

FIG. 5A is a sectional view of the recording head of the ink-jet recording apparatus;

FIG. 5B is an enlarged view of the A portion of the FIG. 5A;

FIG. 10 is a sectional view of a recording head using a longitudinal-mode piezoelectric vibrating member.

BEST MODE FOR CARRYING OUT THE INVENTION

Figure 1:
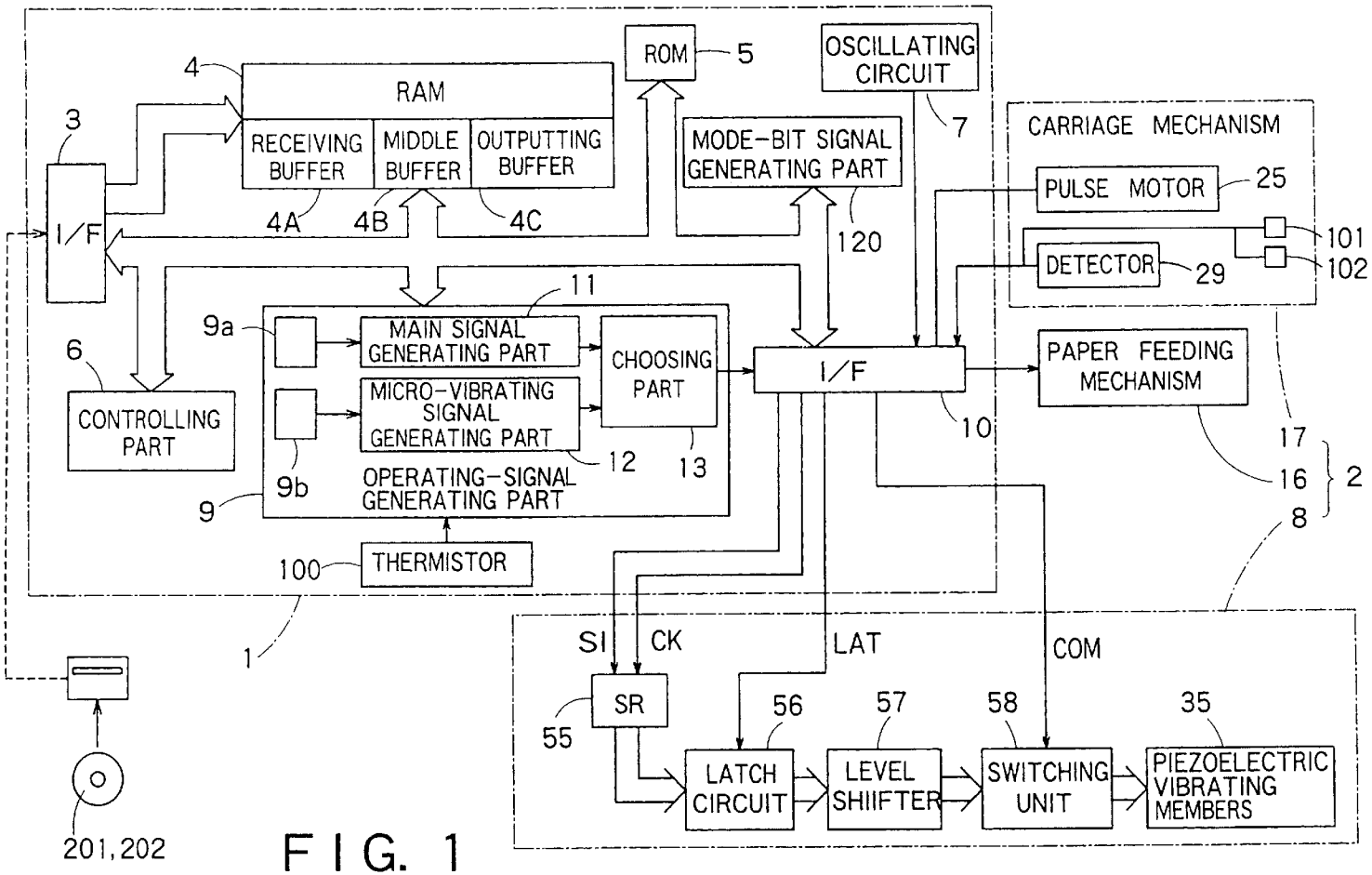
FIG. 1 is a schematic block diagram of an embodiment of the ink-jet recording apparatus according to the invention.

An embodiment of the invention will now be described in more detail with reference to drawings. As shown in FIG. 1, the liquid jetting apparatus of the embodiment is an ink-jet recording printer having a printer controller 1 and a print engine 2.

The printer controller 1 has: an outside interface (outside I/F) 3, a RAM 4 that is able to temporarily store various data, a ROM 5 which stores a controlling program or the like, a controlling part 6 including CPU or the like, an oscillating circuit 7 for generating a clock signal, an operating-signal generating part 9 for generating an operating signal that is to be supplied into a recording head 8 (head member), and an inside interface (inside I/F) 10 that is adapted to send the operating signal, dot-pattern-data (bit-map-data) developed according to printing data (recording data) or the like to the print engine 2.

The outside I/F 3 is adapted to receive printing data consisting of character codes, graphic functions, image data or the like from a host computer not shown or the like. In addtion, a busy signal (BUSY) or an acknowledge signal (ACK) is adapted to be outputted to the host computer or the like through the outside I/F 3.

The RAM 4 has: a receiving buffer 4A, a middle buffer 4B, an outputting buffer 4C and a work memory not shown. The receiving buffer 4A is adapted to receive the printing data through the outside I/F 3, and temporarily store the printing data. The middle buffer 4B is adapted to store middle-code-data converted from the printing data by the controlling part 6. The outputting buffer 4C is adapted to store dot-pattern-data, which are recording-data obtained by decoding (translating) the middle-code-data. The middle-code-data may be gradation data.

The ROM 5 stores font data, graphic functions or the like in addition to the controlling program (controlling routine) for carrying out various data-processing operations.

The controlling part 6 is adapted to carry out various controlling operations according to the controlling program stored in the ROM 5. For example, the controlling part 6 reads out the printing data from the receiving buffer 4A, converts the printing data into the middle-code-data, cause the middle buffer 4B to store the middle-code-data. Then, the controlling part 6 analyzes the middle-code-data in the middle buffer 4B and develops (decodes) the middle-code-data into the dot-pattern-data with reference to the font data and the graphic functions or the like stored in the ROM 5. Then, the controlling part 6 carries out necessary decorating operations to the dot-pattern-data, and thereafter causes the outputting buffer 4C to store the dot-pattern-data.

When the dot-pattern-data corresponding to one line recorded by one main scanning of the recording head 8 are obtained, the dot-pattern-data are outputted to the recording head 8 from the outputting buffer 4C through the inside I/F 10 in turn. When the dot-pattern-data corresponding to the one line are outputted from the outputting buffer 4C, the middle-code-data that has been developed are deleted from the middle buffer 4B, and the next developing operation starts for the next middle-code-data.

The operating-signal generating part 9 has: a main signal generating part 11 for generating a jetting operating signal that is used for jetting ink and for performing mid-recording (mid-jetting) micro-vibrating operations of meniscus 52 (see FIG. 5B), a micro-vibrating-signal generating part 12 for generating a non-recording common micro-vibrating signal and a pre-recording common micro-vibrating signal that are used for performing non-recording (non-jetting) and pre-recording (pre-jetting) micro-vibrating operations of meniscus 52 (see FIG. 5B), and a choosing part 13 that is adapted to be inputted the jetting operating signal from the main signal generating part 11 and the non-recording common micro-vibrating signal or the pre-recording common micro-vibrating signal from the micro-vibrating-signal generating part 12, and to output one of the jetting operating signal, the non-recording common micro-vibrating signal and the pre-recording common micro-vibrating signal to the inside I/F 10.

Figure 2:
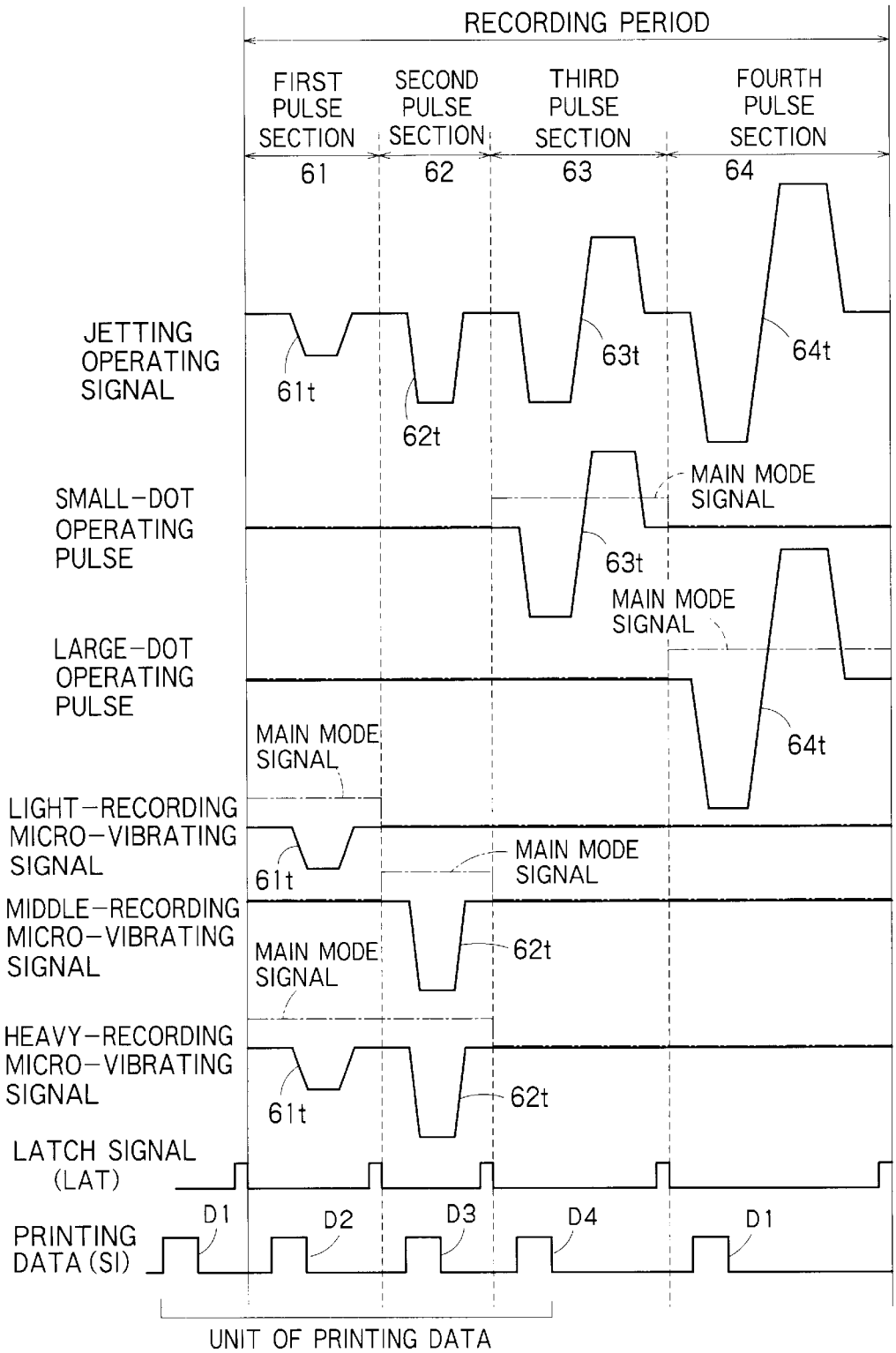
FIG. 2 is an explanatory view of a jetting operating signal and operating pulses generated by the jetting operating signal.

For example, as shown in FIG. 2, the jetting operating signal is a periodical signal serially including: a first pulse portion 61 having a trapezoidal waveform 61*t* that falls down from a base potential by a predetermined first potential and then rises back to the base potential; a second pulse portion 62 having a trapezoidal waveform 62*t* that falls down from a base potential by a predetermined second potential greater than the first potential and then rises back to the base potential; a third pulse portion 63 having a waveform 63*t* that falls down from a base potential by a predetermined third potential substantially the same as the second potential, rises by a potential greater than the third potential, then falls again to the base potential; and a fourth pulse portion 64 having a waveform 64*t* substantially similar to the waveform 63*t* that falls down from a base potential by a predetermined fourth potential greater than the third potential, rises by a potential greater than the fourth potential, then falls again to the base potential.

Figure 3:
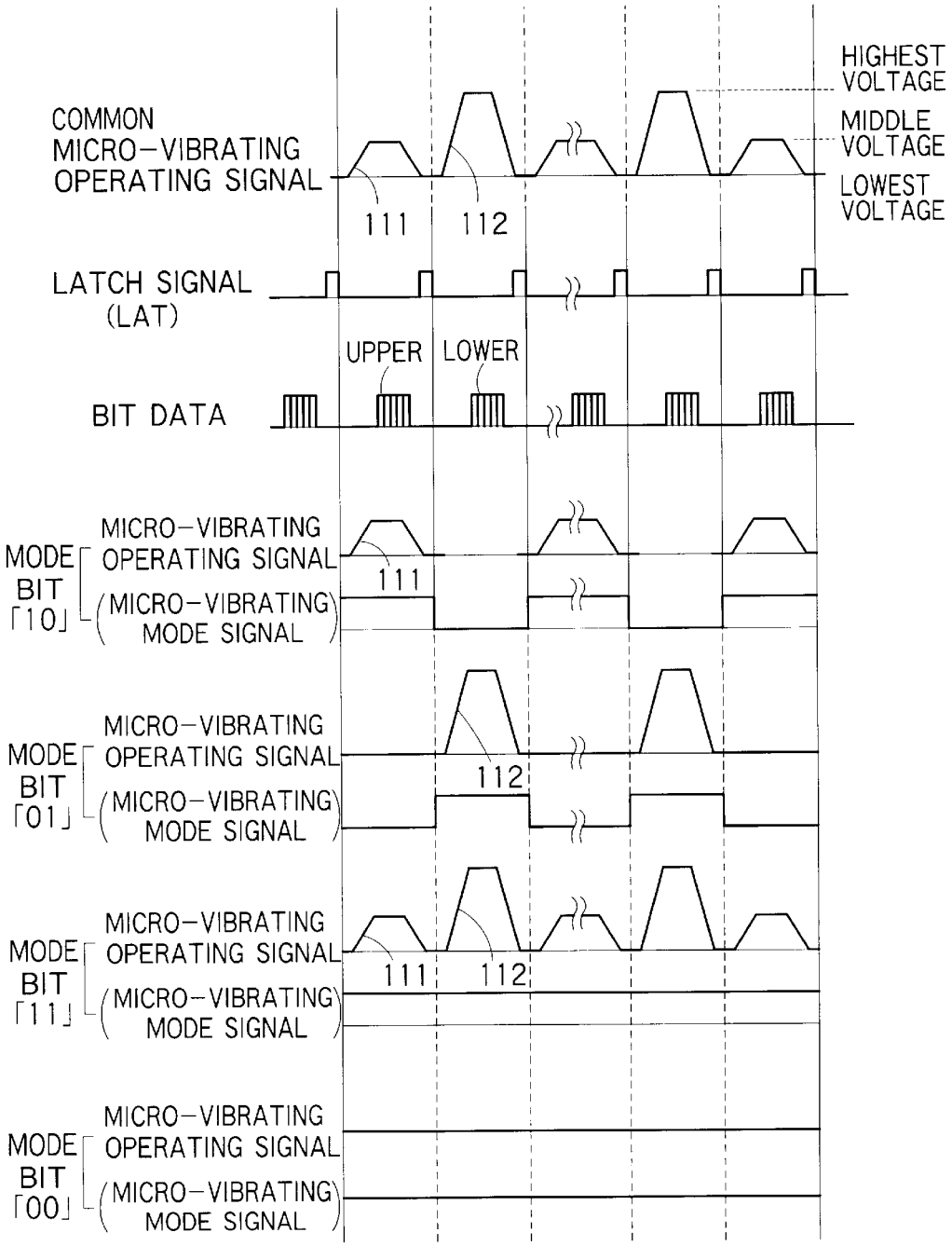
FIG. 3 is an explanatory view of a micro-vibrating operating signal.

On the other hand, the non-recording common micro-vibrating signal and the pre-recording common micro-vibrating signal are usually the same signal. For example, as shown in FIG. 3, the common micro-vibrating signal is formed by a periodical signal serially including a trapezoidal pulse 111 (middle trapezoidal pulse) switched between a lowermost potential and a middle potential and a trapezoidal pulse 112 (large trapezoidal pulse) switched between the lowermost potential and an uppermost potential, which pulses 111 and 112 appear at substantially regular intervals in turn.

The operating-signal generating part 9 may consist of logic circuits, or controlling circuits having a CPU, a ROM, a RAM or the like.

The print engine 2 consists of a paper feeding mechanism 16, a carriage mechanism 17 and the recording head 8.

Figure 4A:
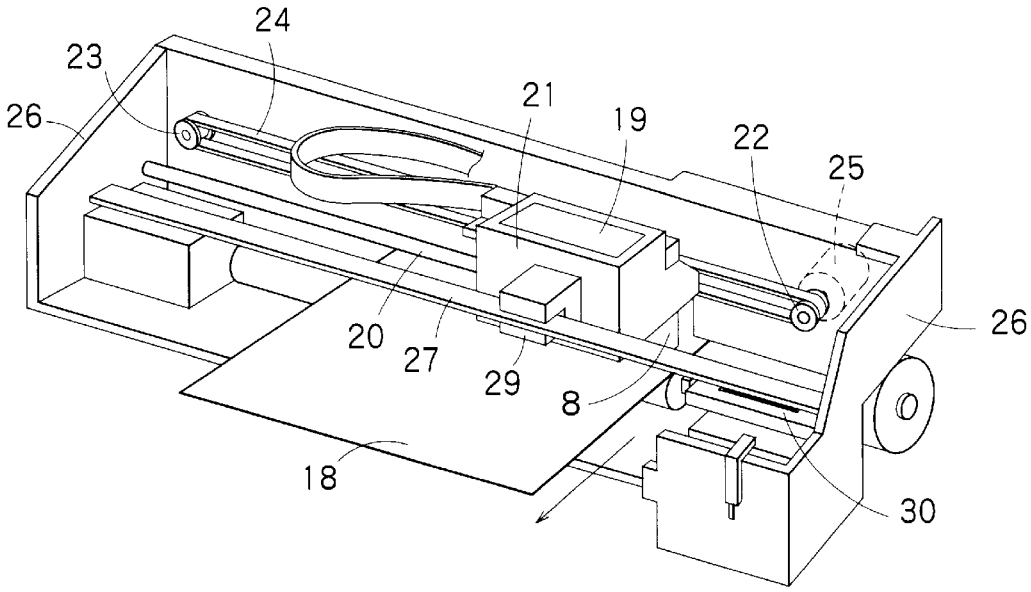
FIG. 4A is a perspective view of the embodiment of the ink-jet recording apparatus shown in FIG. 1.

The paper feeding mechanism 16 consists of a paper feeding motor, a paper feeding roller and so on. As shown in FIG. 4A, a recording paper 18, which is an example of a recording medium, is fed in a subordinate scanning direction in turn by the paper feeding mechanism 16, in cooperation with the scanning operation of the recording head 8.

As shown in FIG. 4A, the carriage mechanism 17 has: a carriage 21 that is slidably mounted on a guiding member 20 and is capable of carrying the recording head 8 and an ink cartridge 19, a timing belt 24 that circulates around a driving pulley 22 and a following pulley 23 and is connected with the carriage 21, a pulse motor 25 for causing the driving pulley 22 to rotate, a linear encoder 27 supported by a printer housing 26 in such a manner that the linear encoder 27 extends in a direction of width of the recording paper 18 (in the main scanning direction), and a slit detector 29 mounted on the carriage 21 and capable of detecting a plurality of slits 28 of the linear encoder 27.

Figure 4B:
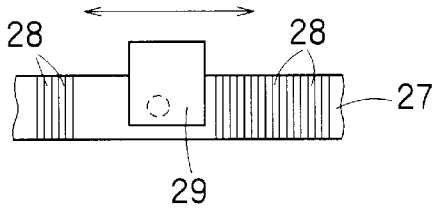
FIGS. 4B and 4C are explanatory views of the linear encoder and the slit detector.
Figure 4C:
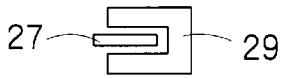

As shown in FIGS. 4B and 4C, the linear encoder 27 of the embodiment consists of a transparent plate. The plurality of slits 28 is formed at pitches of 360 dpi in the linear encoder 27. For example, the slit detector 29 may consist of a photo-interrupter.

According to the carriage mechanism 17 described above, the carriage 21 can reciprocate in the width direction of the recording paper 18 (in the main scanning direction) by driving the pulse motor 25. Thus, the recording head 8 mounted on the carriage 21 can also reciprocate in the main scanning direction. For the movement (reciprocation) of the carriage 21, a standard position as a starting point is set at a side of a home position. The home position means a position where the carriage 21 stands by when the electric power is not supplied, when the scanning operation is not carried out for a long time, or the like. In the embodiment, the home position is located in a right end portion of FIG. 4A.

In the embodiment, a capping mechanism 30 is provided at the home position in order to prevent solvent of ink in nozzles 51 (described below) of the recording head 8 from evaporating.

On the other hand, the standard position is located at a little left position with respect to the home position. In detail, the standard position is located between a right end of the recording paper 18 and the capping mechanism 30.

When the carriage 21 is moved, the slit detector 29 is moved together with the carriage 21. During the movement, the slit detector 29 detects the plurality of slits 28 of the linear encoder 27 in turn, and outputs pulse-like detecting signals each of which corresponds to each of slits 28. The controlling part 6 recognizes a position of the recording head 8 based on the detecting signals from the slit detector 29.

In more detail, the controlling part 6 resets a counting value of a position counter when the carriage 21 is positioned at the standard position. Then, the controlling part 6 receives the pulse-like detecting signals from the slit detector 29 in turn while the carriage 21 is moved. The counting value of the position counter increases by one whenever the controlling part 6 receives one pulse-like signal. Thus, the counting value of the position counter functions as head-position information that represents a position of the carriage 21 i.e. a scanning position of the recording head 8. The position counter may be provided in the work memory (not shown) of the RAM 4. Alternatively, the position counter may be provided separately.

Therefore, the linear encoder 27 and the slit detector 29 function as a scanning-position-information outputting unit. That is, they output information about the position of the recording head 8 (detecting signals) during the main scanning of the carriage 21 (recording head 8). The controlling part 6 and the position counter (RAM 4) function as scanning-position-holding means. That is, they hold the counting value that has been updated according to the detecting signals from the slit detector 29.

Then, the recording head 8 is explained in more detail. As shown in FIG. 5A, the recording head 8 mainly consists of an actuator unit 33 and an ink-way unit 34. The recording head 8 includes bending-mode piezoelectric vibrating members 35 as pressure generating members.

When electric power is supplied to a bending-mode piezoelectric vibrating member 35, the member 35 contracts to deform a pressure generating chamber 36 in such a manner that a volume of the pressure generating chamber 36 becomes smaller. When electric charges are discharged from the bending-mode piezoelectric vibrating member 35, the member 35 expands to deform the pressure generating chamber 36 in such a manner that the volume of the pressure generating chamber 36 returns to an original state thereof.

The actuator unit 33 comprises a first lid 37, a spacer 38, a second lid 39 and piezoelectric vibrating members 35. The ink-way unit 34 comprises an ink-way forming plate 40, an ink-chamber forming plate 41 and a nozzle plate 42. The actuator unit 33 and the ink-way unit 34 are integrated by an adhesive layer 43 to form the recording head 8. The adhesive layer 43 may consist of a thermal welding film or a suitable adhesive material.

The first lid 37 may be an elastic thin plate made of ceramic in general. In the embodiment, the first lid 37 is made of zirconia ($ZrO_2$) having a thickness of about 6 $\mu$m. A common electrode 44 for the piezoelectric vibrating members 35 is formed on an upper surface of the first lid 37. The electric vibrating members 35 are integrated on the common electrode 44 respectively. Driving electrodes 45 for the piezoelectric vibrating members 35 are provided on upper surfaces of the piezoelectric vibrating members 35, respectively.

The spacer 38 may be a ceramic plate having penetrating holes that form pressure generating chambers 36 respectively. In the embodiment, the spacer 38 is made of zirconia, and has a thickness of about 100 $\mu$m.

The second lid 39 may be a ceramic plate having penetrating holes that form supplying-holes 46 respectively at a left side in FIG. 5A and penetrating holes that form first-nozzle-holes 47 respectively at a right side in FIG. 5A. The second lid 39 may be made of zirconia.

The first lid 37 is arranged on an upper surface of the spacer 38. The second lid 39 is arranged on a lower surface of the spacer 38. That is, the spacer 38 is sandwiched between the first lid 37 and the second lid 39. Each of the first lid 37, the spacer 38 and the second lid 39 is molded into a predetermined shape out of clay-like ceramic. Then, the first lid 37, the spacer 38 and the second lid 39 are layered and integrated by baking.

The ink-way forming plate 40 may be a plate having penetrating holes that form ink-supplying-openings 48 respectively at a left side in FIG. 5A and penetrating holes that form first-nozzle-holes 47 respectively at a right side in FIG. 5A. The ink-chamber forming plate 41 may be a plate having penetrating holes that form an ink chamber 49 at a left and middle side in FIG. 5A and penetrating holes that form second-nozzle-holes 50 respectively at a right side in FIG. 5A. The nozzle plate 42 may be a thin plate having nozzles 51 at a right side in FIG. 5A. The nozzles 51 are arranged at pitches (at intervals) that correspond to a density of forming dots, in a subordinate scanning direction. The number of the nozzles is for example 48. The nozzle plate 42 may be made of stainless steel.

The nozzle plate 42 is arranged on a lower surface of the ink-chamber forming plate 41 via an adhesive layer 43. The ink-way forming plate 40 is arranged on an upper surface of the ink-chamber forming plate 41 via an adhesive layer 43. Thus, the ink-way forming plate 40, the ink-chamber forming plate 41 and the nozzle plate 42 are integrated as the ink-way unit 34.

In the recording head 8 described above, the ink chambers 49 of the ink-way unit 34 are communicated with the supplying-holes 46 of the actuator unit 33 through the ink-supplying-openings 48 respectively. The supplying-holes 46 are communicated with the first-nozzle-holes 47 through the pressure generating chambers 36 respectively. The nozzles 51 are communicated with the first-nozzle-holes 47 through the second-nozzle-holes 50 respectively. Thus, ink-ways are formed from the ink chamber 49 to the nozzles 51 through the pressure chambers 36 respectively. Ink (liquid) in the ink cartridge 19 is adapted to be supplied into the ink chambers 49 through ink supplying ways not shown. In the embodiment, common ink is supplied into the respective nozzles 51.

The ink can be jetted from the nozzles 51 by changing the volumes of the pressure chambers 36. In more detail, when electric poser is supplied to a piezoelectric vibrating member 35, the piezoelectric vibrating member 35 contracts in a direction perpendicular to a direction of the electric field. Then, the first lid 37 is deformed in such a manner that a pressure chamber 36 corresponding to the piezoelectric vibrating member 35 contracts with respect to an original state thereof. On the other hand, when electric charges are discharged from the piezoelectric vibrating member 35, the piezoelectric vibrating member 35 expands in the direction perpendicular to the direction of the electric field. Then, the first lid 37 is deformed in such a manner that the pressure chamber 36 corresponding to the piezoelectric vibrating member 35 expands back to the original state thereof. When the pressure chamber 35 contracts rapidly after the pressure chamber 36 has expanded, a pressure of ink in the pressure chamber 36 increases rapidly. Thus, an ink drop is jetted from the nozzle 51 corresponding to the pressure chamber 36 as shown by an alternate long and short dash line in FIG. 5B.

On the other hand, by causing the pressure chamber 36 to expand and contract in such a manner that the ink in the nozzle 51 is not jetted, the ink in the nozzle 51 can be stirred in order to prevent the viscosity of the ink from increasing. In more detail, a meniscus 52 (free surface of the ink exposed at an opening of the nozzle 51) can be caused to minutely vibrate i.e. move to a jetting direction of the ink and to a contracting direction opposed to the jetting direction by turns as shown in FIG. 5B, by causing the pressure chamber 36 to expand and contract in such a manner that the ink is not jetted. Owing to the vibration of the meniscus, the ink at the opening of the nozzle can be stirred in order to prevent the viscosity of the ink from increasing.

Then, an electric structure of the recording head 8 is explained. As shown in FIG. 1, the recording head 8 includes a shift register 55, a latch circuit 56, a level shifter 57 and a switching unit 58 and the piezoelectric vibrating members 35, which are electrically connected in the order. The shift register 55 has a plurality of shift register devices 55A to 55N each of which corresponds to each of the nozzles 51. Similarly, the latch circuit 56 has a plurality of latch devices 56A to 56N each of which corresponds to each of the nozzles 51, the level shifter 57 has a plurality of level shifter devices 57A to 57N each of which corresponds to each of the nozzles 51, and the switching unit 58 has a plurality of switching devices 55A to 55N each of which corresponds to each of the nozzles 51. In addition, each of the piezoelectric vibrating members 35 corresponds to each of the nozzles 51. Thus, the piezoelectric vibrating members 35 are also designated as piezoelectric vibrating members 35A to 35N.

In addition, information about the ink to be used is transmitted to a mode-bit signal generating unit 120 via the host computer not shown and the outside I/F 3. The mode-bit signal generating unit 120 generates a mode-bit signal corresponding to the ink, based on the information about the ink. In the case, the mode-bit signal is formed by digital data consisting of two bits, that is, 00, 01, 10 or 11. Thus, four mode-instructions are achieved dependently on respective characteristics and/or kinds of the ink.

The shift register 55, the latch circuit 56, the level shifter 57, the switching unit 58, the mode-bit signal generating unit 120 and the controlling part 6 are adapted to function as a micro-vibrating-signal supplying (generating) unit. That is, they can generate a micro-vibrating operating signal, which is formed by fusing a non-recording common micro-vibrating signal or a pre-recording common micro-vibrating signal from the micro-vibrating-signal generating part 12 and a micro-vibrating mode signal (described below) dependent on the mode-bit signal, to the recording head 8 (piezoelectric vibrating members 35). Alternatively, they can generate a mid-recording micro-vibrating signal from a jetting operating signal, and output (supply) the signal to the recording head 8.

In addition, the shift register 55, the latch circuit 56, the level shifter 57, the switching unit 58 and the controlling part 6 are adapted to function as operating-pulse supplying means. That is, they can generate an operating pulse (operating-pulse signal) from a jetting operating signal from the operating-signal generating part 9, and output (supply) the operating pulse to the piezoelectric vibrating members 35 of the recording head 8.

Then, a controlling operation for jetting ink is explained.

At first, a controlling operation for causing the meniscus 52 to minutely vibrate with the non-recording common micro-vibrating signal or the pre-recording common micro-vibrating signal from the micro-vibrating-signal generating part 12 in order to stir the ink is explained.

In the case, the controlling part 6 transfers in a serial manner and sets in turn respective upper bit-data of the units of the mode-bit signal from the outputting buffer 4C to the shift register devices 55A to 55N respectively, suitably synchronously with the clock signal (CK) from the oscillating circuit 7. When the upper bit-data of all the units for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the bit-data set in the shift register devices 55A to 55N, respectively. The latched bit-data are supplied to the level shifter 57 i.e. the level shifter devices 57A to 57N, respectively. The level shifter 57 is adapted to function as a voltage amplifier.

For example, when the set datum (bit-data) is 1, each of the level shifter devices 57A to 57N (a micro-vibrating-mode-signal generating unit) raises the datum (bit-data) to a voltage of several decade volt that can drive the switching unit 58 to make a micro-vibrating mode signal (see FIG. 3). The raised datum (the micro-vibrating mode signal) is applied to the switching unit 58 i.e. each of the switching devices 58A to 58N (a signal fusing part). Each of the switching devices 58A to 58N is closed (connected) by the micro-vibrating mode signal. On the other hand, when the set datum (bit-data) is 0, each of the level shifter devices 57A to 57N does not raise the datum.

The non-recording common micro-vibrating signal or the pre-recording common micro-vibrating signal from the micro-vibrating-signal generating part 12 is applied to each of the switching devices 58A to 58N. When each of the switching devices 58A to 58N is closed, the non-recording common micro-vibrating signal or the pre-recording common micro-vibrating signal is supplied to each of the piezoelectric vibrating members 35A to 35N that are connected to the switching devices 58A to 58N.

After the non-recording common micro-vibrating signal or the pre-recording common micro-vibrating signal has been supplied to the piezoelectric vibrating member based on the upper bit-data, the controlling part 6 transfers in a serial manner and sets in turn respective lower bit-data of the units of the mode-bit signal to the shift register devices 55A to 55N respectively. When the lower bit-data are set in the shift register devices 55A to 55N, the controlling part 6 outputs latch signals (LAT) to the latch circuit 56 to latch the set bit-data, and the non-recording common micro-vibrating signal or the pre-recording common micro-vibrating signal is supplied to each of the piezoelectric vibrating members 35A to 35N, respectively.

When the micro-vibrating signal is supplied to the piezoelectric vibrating members 35, the pressure chambers 36 repeat to minutely expand and contract. Thus, as shown in FIG. 5B, the meniscus 52 can be minutely vibrated between a position of a jetting side and a position of a contracting side nearer to the pressure chamber 36. In FIG. 5B, the position of the jetting side is designated by a broken line, and the position of the contracting side is designated by a real line. Owing to the vibration of the meniscus 52, the ink at the opening of the nozzle can be stirred.

As described above, the printer can control whether to supply the non-recording common micro-vibrating signal or the pre-recording common micro-vibrating signal to the piezoelectric vibrating members 35 based on the mode-bit signal. That is, if a bit-data of the mode-bit signal is "1", a micro-vibrating operating signal being an AND signal of a rectangular-pulse-shaped micro-vibrating mode signal formed by the latched and raised bit-data and the non-recording common micro-vibrating signal or the pre-recording common micro-vibrating signal may be supplied to the corresponding piezoelectric vibrating member 35. If a bit-data of the mode-bit signal is "0", the non-recording common micro-vibrating signal or the pre-recording common micro-vibrating signal may not be supplied to the corresponding piezoelectric vibrating member 35. Herein, if a bit-data is "0", the piezoelectric vibrating member 35 holds previous electric charges i.e. a previous voltage.

Thus, a plurality of micro-vibrating operating signals can be made selectively from one common micro-vibrating signal, when the common micro-vibrating signal is divided into some sections with respect to time and each bit-data of the units of mode-bit signal is set correspondingly to each of the divided sections. The generated micro-vibrating operating signals may be supplied to the piezoelectric vibrating members 35. Thus, if the mode-bit signal is generated correspondingly to the ink to be used, the ink can be stirred sufficiently. In addition, it is prevented that the nozzles may drip with the ink so that the ink may not be jetted from the nozzles accurately but deflected.

In this example, as shown in FIG. 3, the common micro-vibrating signal is formed by the periodical signal serially including the trapezoidal pulse 111 switched between the lowermost potential and the middle potential and the trapezoidal pulse 112 switched between the lowermost potential and the uppermost potential, which pulses 111 and 112 appear at substantially regular intervals in turn. The mode-bit signal is adapted to be generated in order of "11" "01" "10" and "00" according to characteristic of increasing viscosity of the ink, that is, according to tendency for the viscosity of the ink to increase. Thus, according to the characteristic of increasing viscosity of the ink, an appropriate micro-vibrating signal may be supplied to the piezoelectric vibrating members 35 in order to perform suitable non-recording and/or pre-recording micro-vibrating controls.

The waveform of the common micro-vibrating signal (the number of trapezoidal pulses 111, 112, each waveform of trapezoidal pulses 111, 112, interval between trapezoidal pulses 111, 112, and so on) and the number of the bit-data of the mode-bit signal (the number of patterns of the micro-vibrating mode signal) are not limited by the above embodiment, but could be determined suitably.

Next, the operating pulse is supplied to the piezoelectric vibrating members 35 as follows. Herein, each of printing data forming the dot-pattern-data corresponds to one dot and consists of four bits.

In the case, the controlling part 6 transfers in a serial manner and sets in turn data of respective uppermost bits of the units of the printing data (SI) from the outputting buffer 4C to the shift register devices 55A to 55N respectively, synchronously with the clock signal (CK) from the oscillating circuit 7. When the uppermost data of all the units for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the data set in the shift register devices 55A to 55N respectively. The latched data are supplied to the level shifter 57 i.e. the level shifter devices 57A to 57N respectively. The level shifter 57 is adapted to function as a voltage amplifier.

For example, when the set datum is 1, each of the level shifter devices 57A to 57N (a main-mode-signal generating unit) the datum to a voltage of several decade volt that can drive the switching unit 58 to make a main mode signal (see FIG. 2). The raised datum (the main mode signal) is applied to the switching unit 58 i.e. each of the switching devices 58A to 58N. Each of the switching devices 58A to 58N is closed (connected) by the raised datum. On the other hand, when the set datum is 0, each of the level shifter devices 57A to 57N does not raise the datum.

A jetting operating signal (COM) from the main-signal generating part 11 is applied to each of the switching devices 58A to 58N. When each of the switching devices 58A to 58N is closed, the jetting operating signal is supplied to each of the piezoelectric vibrating members 35A to 35N that are connected to the switching devices 58A to 58N.

After the jetting operating signal has been supplied to the piezoelectric vibrating members based on the uppermost bits, the controlling part 6 transfers in a serial manner and sets data of respective secondly uppermost bits of the units of the printing data (SI) to the shift register devices 55A to 55N respectively. When the second data are set in the shift register devices 55A to 55N, the controlling part 6 outputs latch signals (LAT) to the latch circuit 56 to latch the set data, and the jetting operating signal is supplied to each of the piezoelectric vibrating members 35A to 35N respectively. Thereafter, the similar operations are repeated for from the thirdly uppermost bits to the lowermost bits in the order.

As described above, the printer can control whether to supply the jetting operating signal to the piezoelectric vibrating members 35 base on the printing data. That is, if the printing datum is "1", an operating pulse signal being an AND signal of a rectangular-pulse-shaped main mode signal formed by the latched and raised printing-data and the jetting operating signal may be supplied to the corresponding piezoelectric vibrating member 35. If the printing datum is "0", the jetting operating signal may not be supplied to the corresponding piezoelectric vibrating member 35. Herein, if a printing datum is "0", the piezoelectric vibrating member 35 holds previous electric charges i.e. a previous voltage.

Thus, a plurality of operating pulses and a plurality of mid-recording micro-vibrating signals can be made selectively from one jetting operating signal, when the jetting operating signal is divided into some sections with respect to time and each of the bits of the units of the printing data is set correspondingly to each of the sections of the jetting operating signal. The generated operating pulse or mid-recording micro-vibrating signal may be supplied to each of the piezoelectric vibrating members 35. Thus, a meniscus 52 of ink in a nozzle not in a recording operation can be suitably vibrated while another nozzle is in the recording operation in order to sufficiently stir the ink in the former nozzle and to prevent that the former nozzle may drip with the ink so that the ink may not be jetted from the former nozzle accurately but deflected. In addition, the plurality of operating pulses corresponding to a plurality of volumes of ink (dot diameters) can be supplied to each of the piezoelectric vibrating members 35 of the recording head 8.

For example, as shown in FIG. 2, the jetting operating signal is divided into a first pulse section 61, a second pulse section 62, a third pulse section 63 and a fourth pulse section 64. A light mid-printing micro-vibrating signal is generated by the first pulse section 61 solo. A middle mid-printing micro-vibrating signal is generated by the second pulse section 62 solo. A heavy mid-printing micro-vibrating signal is generated by combining the first pulse section 61 and the second pulse section 62. A small-dot operating pulse is generated by the third pulse section 63 solo. A large-dot operating pulse is generated by the fourth pulse section 64 solo.

The small-dot operating pulse is an operating pulse that can cause a small-sized inkdrop forming a small-sized dot to be jetted. The large-dot operating pulse is an operating pulse that can cause a large-sized inkdrop forming a large-sized dot to be jetted. The light mid-recording micro-vibrating pulse (signal) is an operating pulse that can cause the meniscus 52 of the ink in the nozzle 51 not in the recording operation to lightly and minutely vibrate. The middle mid-recording micro-vibrating pulse (signal) is an operating pulse that can cause the meniscus 52 of the ink in the nozzle 51 not in the recording operation to minutely vibrate in a middle level. The heavy mid-recording micro-vibrating pulse (signal) is an operating pulse that can cause the meniscus 52 of the ink in the nozzle 51 not in the recording operation to heavily and minutely vibrate.

When each of the mid-recording micro-vibrating signals is supplied to the piezoelectric vibrating members 35, the pressure chambers 36 repeat to minutely expand and contract. Thus, as shown in FIG. 5B, the meniscus 52 can be minutely vibrated between a position of a jetting side and a position of a contracting side nearer to the pressure chamber 36. In FIG. 5B, the position of the jetting side is designated by the broken line, and the position of the contracting side is designated by the real line. Owing to the vibration of the meniscus 52, the ink at the opening of the nozzle can be stirred.

In the embodiment, the printing data consist of data of four bits D1, D2, D3 and D4. When D1=0, D2=0, D3=1 and D4=0 are set, the small-dot operating pulse is adapted to be generated. When D1=0, D2=0, D3=0 and D4=1 are set, the large-dot operating pulse is adapted to be generated. When D1=1, D2=0, D3=0 and D4=0 are set, the light mid-recording micro-vibrating pulse is adapted to be generated. When D1=0, D2=1, D3=0 and D4=0 are set, the middle mid-recording micro-vibrating pulse is adapted to be generated. When D1=1, D2=1, D3=0 and D4=0 are set, the heavy mid-recording micro-vibrating pulse is adapted to be generated. When D1=0, D2=0, D3=0 and D4=0 are set, neither operating pulse nor mid-recording micro-vibrating pulse is adapted to be generated.

The light mid-recording micro-vibrating pulse, the middle mid-recording micro-vibrating pulse and the heavy mid-recording micro-vibrating pulse are generated according to respective characteristics of increasing viscosity of the ink. That is, if the viscosity of the ink is relatively easy to increase, the heavy mid-recording micro-vibrating pulse is generated. If the viscosity of the ink is relatively not easy and not difficult to increase, the middle mid-recording micro-vibrating pulse is generated. If the viscosity of the ink is relatively difficult to increase, the light mid-recording micro-vibrating pulse is generated. Thus, according to the respective characteristics of increasing viscosity of the ink, suitable mid-recording controls can be performed.

Herein, the mode bit signal also may be used as upper two bit-data D1 and D2 of the printing data. For example, if the lower two bit-data D3 and D4 are "0", the upper and lower bit-data of the mode bit signal may be inputted as the upper two bit-data D1 and D2, respectively. If at least one of the lower two bit-data D3 and D4 is not "0", "0" is inputted for the upper two bit-data D1 and D2. Thus, the above operating pulses and mid-printing micro-vibrating pulses may be generated. In the case, since only two bit-data of the printing data are meaningful, various processes can be conducted more simply and more quickly.

The number of bit-data of the printing data and the respective waveforms and/or kinds of the mid-printing micro-vibrating pulses are not limited by the above embodiment, but could be determined suitably. The number of kinds of the mid-printing micro-vibrating pulses is preferably the same as the number of kinds of the mode bit signals in the non-printing and pre-printing micro-vibrating controls, but could not be the same.

Then, a scanning operation including a recording operation of the printer described above is explained in more detail. In the printer, the menisci 52 can minutely vibrate to prevent the viscosity of ink from increasing in cooperation with a main scanning of the recording head 8, i.e., in cooperation with the scanning operation for a line. In more detail, the menisci 52 can minutely vibrate while the recording head 8 (carriage 21) is being accelerated, just before the starting of the recording operation, and during the recording operation.

Figure 7:
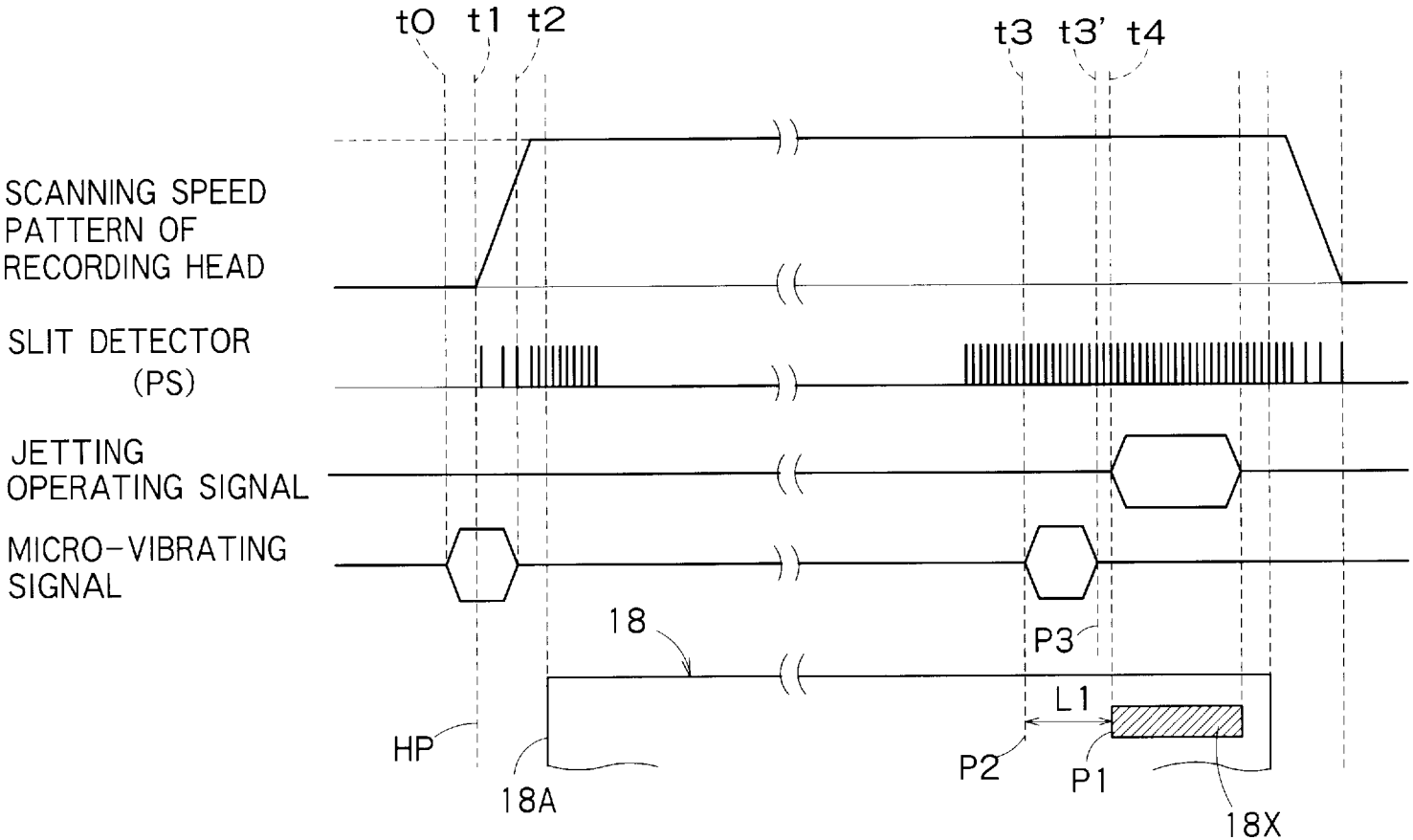
FIG. 7 is a timing chart for explaining a recording operation for a line.

As shown in FIG. 7, in the case, an image 18X is recorded in an area opposed to the home position HP in the recording paper 18, that is, in the latter half of a line.

Figure 8:
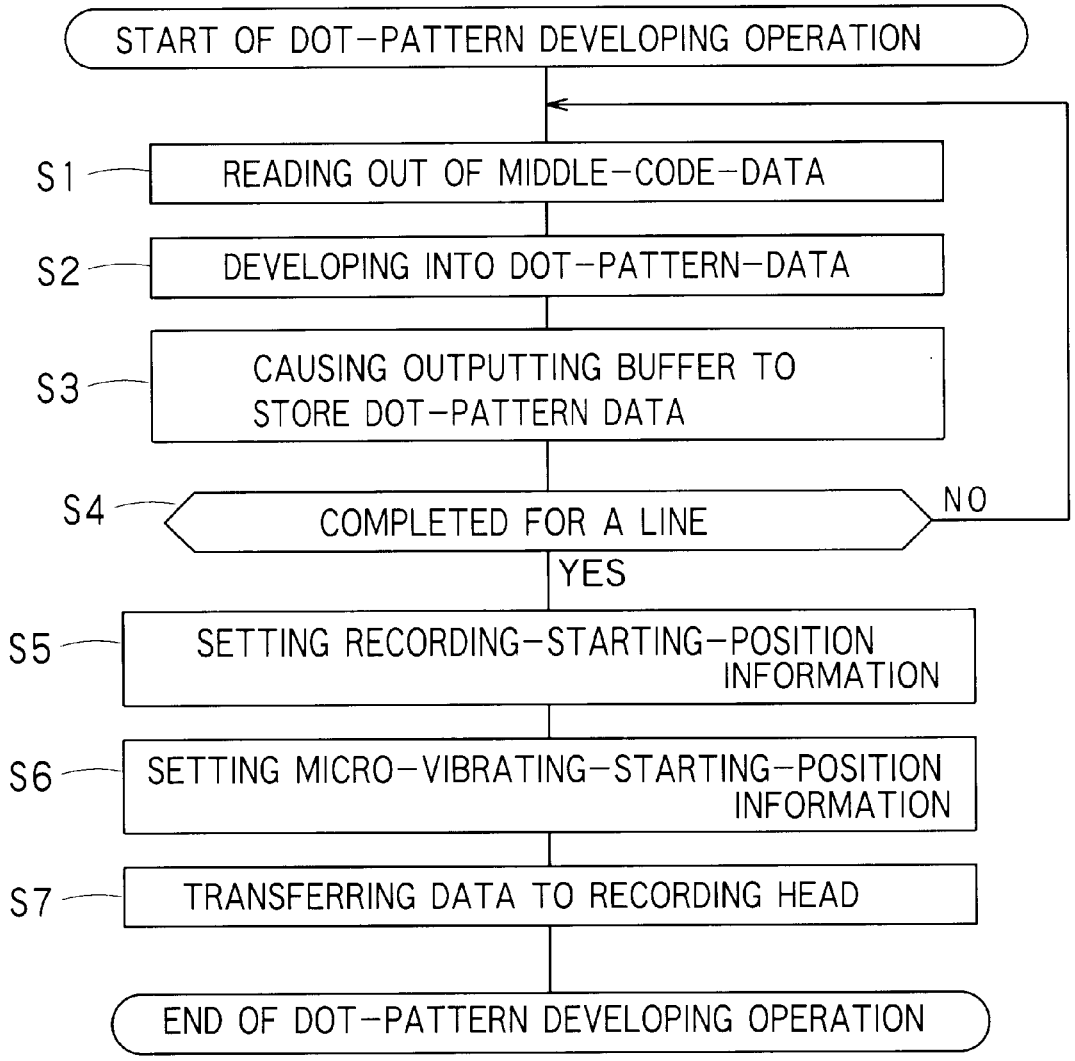
FIG. 8 is a flowchart for explaining a dot-pattern developing operation.
Figure 9A:
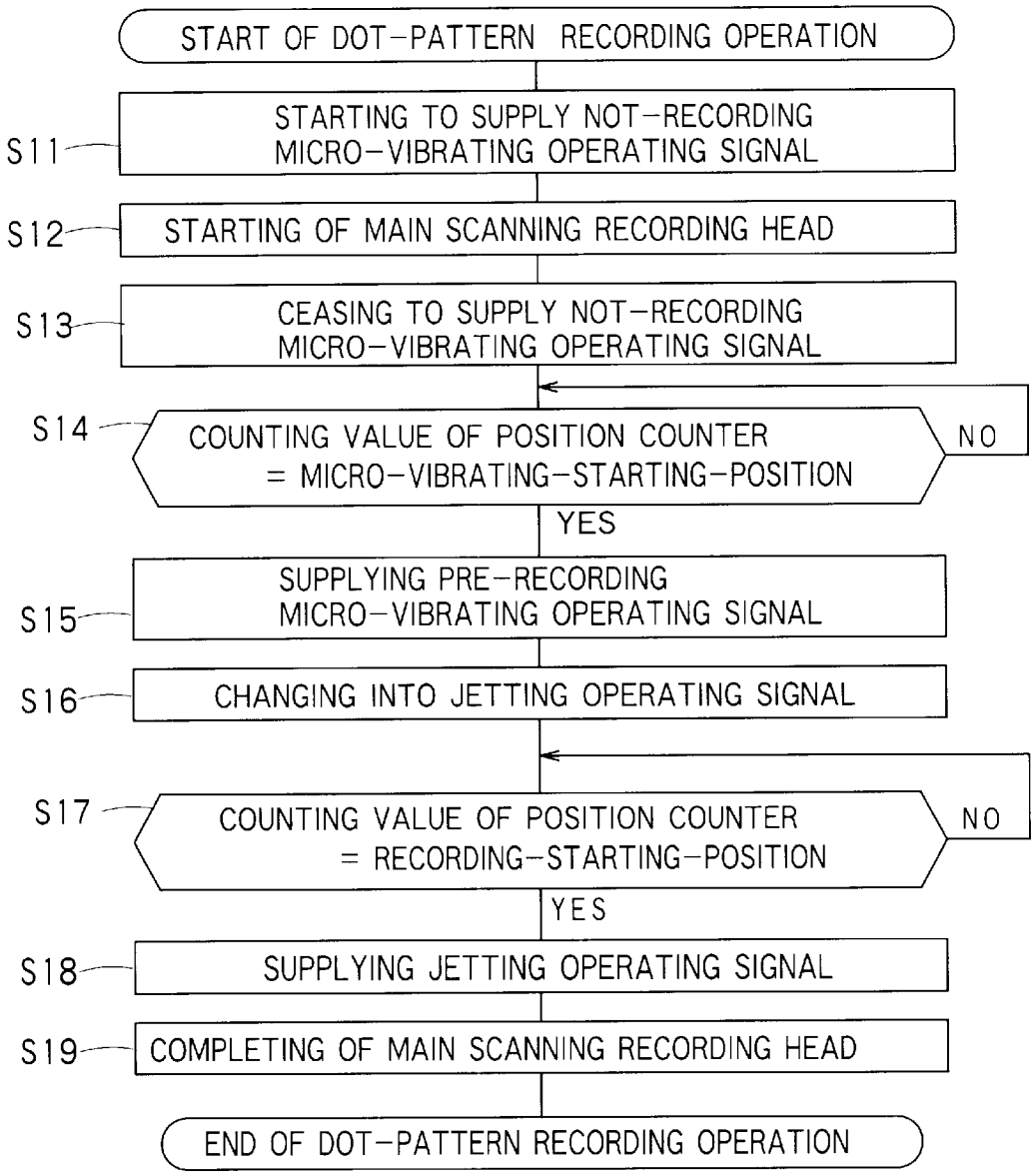
FIG. 9A is a flowchart for explaining a dot-pattern recording operation.
Figure 9B:
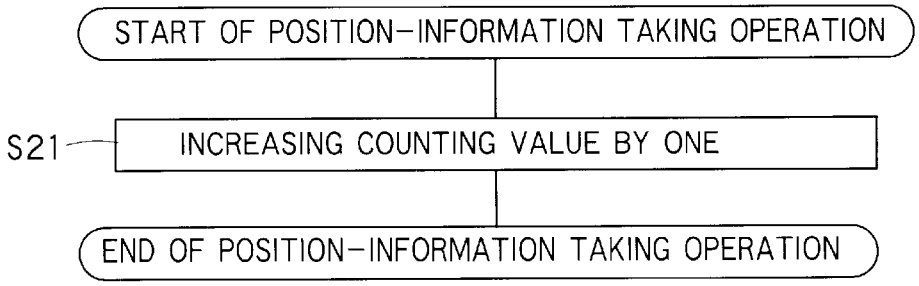
FIG. 9B is a flowchart for explaining a position-information taking operation.

FIG. 7 is a timing chart for explaining the scanning operation including the recording operation for the line. In FIG. 7, there are also shown the recording paper 18, and a relationship between a recording area by the recording head 8 and time. FIG. 8 is a flowchart for explaining a dot-pattern developing operation. FIG. 9A is a flowchart for explaining a dot-pattern recording operation. FIG. 9B is a flowchart for explaining a position-information taking operation that may be carried out interrupting the dot-pattern recording operation.

The recording operation is mainly divided into the dot-pattern developing operation for generating dot-pattern-data for the line from the middle-code-data, and the dot-pattern recording operation for recording (jetting ink) on the recording paper 18 based on the developed dot-pattern-data.

Each of the dot-pattern developing operation and the dot-pattern recording operation is explained as below.

In the dot-pattern developing operation shown in FIG. 8, the controlling part 6 functions as a dot-pattern-data generating unit to generate the dot-pattern-data for the line. That is, the controlling part 6 reads out middle-code-data stored in the middle buffer 4B (S1), develops the middle-code-data into a part of the dot-pattern-data based on the font data and the graphic functions or the like stored in the ROM 5 (S2), and causes the outputting buffer 4C to store the part of the developed dot-pattern-data (S3). Then, the developing operation is repeated until all the parts of the dot-pattern-data for the line are stored in the outputting buffer 4C (S4).

When the dot-pattern-data corresponding to the line are stored in the outputting buffer 4C, the controlling part 6 functions as a recording-starting-position-information setting unit to set recording-starting-position information that represents a position where a nozzle should start to record in the line, that is, where a first ink drop should be jetted from the nozzle during the main scanning (S5). In FIG. 7, the recording-starting-position is designated by a reference sign P1.

In the embodiment, the recording-starting-position information is set correspondingly to the counting value about the slits 28 of the linear encoder 27, that is, the counting value of pulses PS outputted from the slit detector 29.

Then, the controlling part 6 functions as a micro-vibrating-starting-position-information setting unit to set micro-vibrating-starting-position information that represents a position where the micro-vibrating unit should start to cause the ink to minutely vibrate, for example just before starting the recording operation (S6). For example, the micro-vibrating-starting-position is set at a position P2 back to the home position HP from the recording-starting-position P1 by a distance L1 that is necessary for the menisci to keep minutely vibrating and to settle down thereafter. That is, the setting of the micro-vibrating-starting-position P2 is carried out based on the recording-starting-position information that has been set previously. Then, a counting value obtained by subtracting a counting value corresponding to the distance L1 from a counting value corresponding to the recording-starting-position P1 is set as a counting value corresponding to the micro-vibrating-starting-position P2.

When the micro-vibrating-starting-position information is set, the controlling part 6 transfers the developed dot-pattern-data to the recording head 8 (S7). On transferring the developed dot-pattern-data, a scanning operation starts for the line, that is, the recording head 8 starts scanning in the main scanning direction. In addition, a micro-vibrating controlling operation that cause the menisci 52 to minutely vibrate to stir the ink in the nozzles 51 is carried out in cooperation with the main scanning of the recording head 8. During the micro-vibrating controlling operation, the controlling part 6 functions as a micro-vibrating controlling unit.

After transferring the dot-pattern-data, the controlling part 6 carries out the dot-pattern recording operation. In the dot-pattern recording operation, the controlling part 6 functions as a not-recording micro-vibrating controlling unit (one kind of the micro-vibrating controlling unit) to stir the ink while the carriage 21 is being accelerated. That is, on transferring the dot-pattern-data, the controlling part 6 supplies a not-recording common micro-vibrating signal from the micro-vibrating-signal generating part 12 to the piezoelectric vibrating members 35 of the recording head 8.

As shown in FIGS. 7 and 9A, the controlling part 6 starts to supply the not-recording common micro-vibrating signal (S11, t0), and then starts the scanning of the recording head (S12, t1). In the case, the controlling part 6 ceases to supply the not-recording common micro-vibrating signal at a timing just before a speed of the recording head 8 ceases to increase but becomes constant (S13, t2).

During the series of steps, the controlling part 6 outputs such a controlling signal to the choosing part 13 that the non-recording common micro-vibrating signal from the micro-vibrating-signal generating part 12 is allowed to be supplied to the piezoelectric vibrating members 35. Then, the controlling part 6 sets the respective bit-data of the mode bit signal in the shift register 55, and outputs the latch signals to the latch circuit 56 to generate the micro-vibrating signal corresponding to the characteristic of increasing viscosity of the ink and supply the micro-vibrating signal to the piezoelectric vibrating members 35 (see FIG. 3). Then, the controlling part 6 supplies an operating pulse to the pulse motor 25 to move the carriage 21 in the main scanning direction. Thus, the recording head 8 starts scanning. If a stopping timing for the non-recording micro-vibrating signal is judged, the non-recording common micro-vibrating signal stops being supplied from the micro-vibrating-signal generating unit 12. Thus, the non-recording micro-vibrating operations are stopped.

During the scanning of the recording head 8, the slit detector 29 mounted on the carriage 21 detects the slits 28 of the linear encoder 27, and outputs pulse-like detecting signals that are shown with reference sign PS in FIG. 7. The controlling part 6 watches the detecting signals and carries out the position-information taking operation whenever each of the detecting signals is received. The position-information taking operation is carried out interrupting the dot-pattern recording operation. In the position-information operation, the position counter is updated (S21). In more detail, the counting value of the position counter that represents head-position information increases by one based on each of the detecting signals from the slit detector 29. After the counting value has increased by one, the dot-pattern recording operation is resumed. Herein, the counting value of the position counter may be reset when the scanning of the recording head 8 for the line is completed or when the recording head 8 is returned at the standard position. During the scanning of the recording head 8, the controlling part 6 also functions as a pre-recording micro-vibrating-starting-timing judging unit, that is, judges a micro-vibrating-starting timing just before the recording operation (S14). In the embodiment, the controlling part 6 can judge the pre-recording micro-vibrating-starting timing by comparing the counting value of the position counter with the counting value corresponding to the micro-vibrating-starting-position P2 (micro-vibrating-starting-position information) because the controlling part 6 watches the counting value of the position counter (t3).

When the controlling part 6 judges that it is the pre-recording micro-vibrating-starting timing, the controlling part 6 functions as a pre-recording micro-vibrating controlling unit (one kind of the micro-vibrating controlling unit) to supply a pre-recording common micro-vibrating signal to the piezoelectric vibrating members 35 (S15).

That is, the controlling part 6 outputs such a controlling signal to the choosing part 13 that the pre-recording common micro-vibrating signal from the micro-vibrating-signal generating part 12 is allowed to be supplied to the piezoelectric vibrating members 35. Then, the controlling part 6 sets the respective bit-data of the mode bit signal in the shift register 55, and outputs the latch signals to the latch circuit 56 to generate the micro-vibrating signal corresponding to the characteristic of increasing viscosity of the ink and supply the micro-vibrating signal to the piezoelectric vibrating members 35 (see FIG. 3). If a predetermined stopping timing (t3'), which is described below, is judged, the pre-recording common micro-vibrating signal stops being supplied from the micro-vibrating-signal generating unit 12. Thus, the pre-recording micro-vibrating operations are stopped.

While the pre-recording micro-vibrating signal is supplied, the menisci 52 minutely vibrates to stir the ink. Thus, the viscosity of the ink in the nozzles may be returned at a normal level even when the viscosity of the ink at the openings in the nozzles has increased as the solvent of the ink has evaporated.

The predetermined stopping timing (t3') can be judged by using a timer for measuring a time (t3'–t3) for which the pre-recording common micro-vibrating signal is being supplied. In the case, the predetermined stopping timing (t3') can be judged when the pre-recording common micro-vibrating signal is supplied for the predetermined time (t3'–t3), that is, when the timer measures the predetermined time (t3'–t3). Alternatively, the predetermined stopping timing (t3') can be judged by comparing the counting value of the position counter with a predetermined counting value P3.

Then, after ceasing to supply the pre-recording common micro-vibrating signal, the controlling part 6 outputs such a controlling signal to the choosing part 13 of the operating-signal generating part 9 that the jetting operating signal from the main signal generating part 11 is allowed to be supplied to the piezoelectric vibrating members 35 (S16).

After outputting the controlling signal, the controlling part 6 also functions as a recording-starting-timing judging unit (means), that is, judges a recording-starting timing (S17). In the embodiment, the controlling part 6 can judge the recording-starting timing by comparing the counting value of the position counter with the counting value corresponding to the recording-starting-position P1 because the controlling part 6 watches the counting value of the position counter (t4).

When the controlling part 6 judges that it is the recording-starting timing, the controlling part 6 supplies the jetting operating signal to the piezoelectric vibrating members 35 to record (jet the ink) on the recording paper 18 (S18). In the case, as shown in FIG. 2, one of the small-dot operating pulse, the large-dot operating pulse and the respective mid-recording micro-vibrating signals is supplied to each of the piezoelectric vibrating members 35A to 35N, based on the dot-pattern-data. Then, the ink drop jetted from the nozzle forms a small dot or a large dot correspondingly to the supplied operating pulse.

In addition, one of the respective mid-recording micro-vibrating signals corresponding to the characteristics of increasing viscosity of the ink is supplied for a nozzle or nozzles 51 which do not jet ink, so that a meniscus or menisci of the ink in the nozzle or the nozzles 51 can minutely vibrate to stir the ink.

According to the above control, the ink drop can be jetted in a state wherein the viscosity of the ink is returned at a normal level by the micro-vibrating of the meniscus 52 just before the jetting. Thus, a first ink drop of a line can be jetted accurately in a predetermined direction. Therefore, the deterioration of the quality of the recorded (printed) image is effectively prevented especially at the position where the printing operation starts even when the volume of the jetted ink is so small that the viscosity of the ink is liable to increase.

Especially when the recording paper is large-sized, the ink drop may not be jetted for such a longer time that the viscosity of the ink is liable to increase. However, even in the case, the above control can certainly prevent the deterioration of the quality of the printed image at the position where the printing operation starts.

After the scanning operation for the line is completed, the pulse motor 25 is stopped (S19). Then, the recording head 8 is moved toward the home position HP, and is positioned at the standard position. Then, the similar scanning operation including the recording operation is repeated for the next line.

In the above embodiment, the menisci 52 can minutely vibrate to stir the ink both of while the carriage 21 is being accelerated and for a predetermined time just before the recording operation. However, the pre-recording micro-vibrating just before the recording operation may be carried out only when the recording operation starts at a position in a predetermined area, for example in the latter half of a line. That is, the controlling part 6 (micro-vibrating controlling unit) may carry out the pre-recording micro-vibrating operation only when a recording-starting position represented by the recording-starting-position information is in the right (latter) area with respect to a predetermined position. In the case as well, the viscosity of the ink is sufficiently prevented from increasing, because the ink may be sufficiently stirred by only the not-recording micro-vibrating operation (micro-vibrating operation during the accelerating time) when the recording operation starts at a position in the left (former) area with respect to the predetermined position.

In addition, in general, the printer is arranged in an environment whose temperature is in a wide range of from several centigrade to forty and several centigrade. There is a difference in the viscosity of the ink between at a higher temperature and at a lower temperature, even if the ink is the same kind. That is, the viscosity of the ink at the lower temperature is relatively high, while the viscosity of the ink at the higher temperature is relatively low. Because of the difference in the viscosity of the ink by the temperature, if the same micro-vibrating signal is applied for the case of the higher temperature and for the case of the lower temperature, the menisci 52 may vibrate with a greater amplitude than a necessary amplitude in the case of the higher temperature, while the menisci 52 may not sufficiently vibrate in the case of the lower temperature.

Therefore, as shown in FIG. 1, in the ink-jetting recording apparatus of the embodiment, a thermistor 100 (one kind of temperature detecting part) for measuring the environmental temperature is provided, and an amplitude and a waveform of the micro-vibrating signal (non-recording micro-vibrating signal, pre-recording micro-vibrating signal or mid-recording micro-vibrating signal) can be changed based on the temperature measured by the thermistor 100. For example, the thermistor 100 is mounted on a print substrate (not shown) of the recording head 8 to measure a temperature of a surrounding of the recording head 8 accurately.

The operating-signal generating part 9 has a micro-vibrating-signal determining part 9*b*, which sets the amplitude (voltage) and the waveform (for example, inclinations of rising and falling segments of the respective trapezoidal pulses 111 and 112) of the micro-vibrating common signal in such a manner that the meniscus 52 can minutely vibrate with a stronger force, when the environmental temperature is lower, that is, the viscosity of the ink is higher. The micro-vibrating-signal determining part 9*b* sets the amplitude and the waveform of the micro-vibrating common signal in such a manner that the meniscus 52 can minutely vibrate with a weaker force, when the environmental temperature is higher, that is, the viscosity of the ink is lower. Then, the micro-vibrating-signal generating part 12 as a signal-generating part generates the micro-vibrating common signal based on the amplitude and the waveform set by the micro-vibrating-signal determining part 9*b*.

Thus, in the non-printing and the pre-printing micro-vibrating operations, the meniscus 52 can vibrate with a substantially constant amplitude to stir the ink at the opening of the nozzle most suitably, regardless of the environmental temperature.

Similarly, the operating-signal generating part 9 has a main-signal determining part 9*a*, which sets the respective amplitudes (voltages) and the respective waveforms of the first pulse portion 61 and the second pulse portion 62 of the jetting operating signal (for example, inclinations of rising and falling segments of the respective trapezoidal pulses 61*t* and 62*t*) in such a manner that the meniscus 52 can minutely vibrate with a stronger force, when the environmental temperature is lower, that is, the viscosity of the ink is higher. The main-signal determining part 9*b* sets the respective amplitudes and the respective waveforms of the first pulse portion 61 and the second pulse portion 62 of the jetting operating signal in such a manner that the meniscus 52 can minutely vibrate with a weaker force, when the environmental temperature is higher, that is, the viscosity of the ink is lower. Then, the main-signal generating part 11 as a signal-generating part generates the jetting operating signal based on the amplitudes and the waveforms set by the main-signal determining part 9*a*.

Thus, in the mid-printing micro-vibrating operations, the meniscus 52 can vibrate with a substantially constant amplitude to stir the ink at the opening of the nozzle most suitably, regardless of the environmental temperature.

Similarly, the respective amplitudes and the respective waveforms of third pulse portion 63 and the fourth pulse portion 64 also may be set by the micro-vibrating-signal determining part 9*b* based on the temperature detected by the thermistor 100.

In addition, instead of changing the amplitudes and the waveforms of the signals by the signal determining parts 9*a* and 9*b*, it is effective to change the values of the mode bit signal and/or the bit-data D1 and D2 of the printing data, based on the temperature detected by the thermistor 100, as below.

TABLE 1

| | Temperature detected by Thermistor | | | | |
|---|---|---|---|---|---|
| | Low | ← | Middle | → | High |
| Mode Bit Signal | 10 | ← | 00 | → | 00 |
| or | 01 | ← | 10 | → | 00 |
| Bit-Data D1, D2 | 11 | ← | 01 | → | 10 |
| | 11 | ← | 11 | → | 01 |

In the above embodiment, the mode-bit signal is adapted to be generated in order of "11" "01" "10" and "00" according to characteristic of increasing viscosity of the ink, that is, according to tendency for the viscosity of the ink to increase. Thus, according to the characteristic of increasing viscosity of the ink, an appropriate micro-vibrating operating signal may be supplied to the piezoelectric vibrating members 35 in order to perform suitable non-recording and/or pre-recording micro-vibrating controls.

Herein, if the temperature of the ink is lower, it is thought that the viscosity of the ink tends to increase. Thus, in a simpler manner, it is effective that the mode-bit signal may be generated in order of "11" "01" "10" and "00" according to the temperature of the ink, that is, according to lowness of the temperature of the ink. In the case too, an appropriate micro-vibrating operating signal may be supplied to the piezoelectric vibrating members 35 in order to perform suitable non-recording and/or pre-recording micro-vibrating controls.

The mid-recording micro-vibrating controls may be the same. In the above embodiment, the printing data consist of data of four bits D1, D2, D3 and D4. When D1=0, D2=0, D3=1 and D4=0 are set, the small-dot operating pulse is adapted to be generated. When D1=0, D2=0, D3=0 and D4=1 are set, the large-dot operating pulse is adapted to be generated. When D1=1, D2=0, D3=0 and D4=0 are set, the light mid-recording micro-vibrating pulse is adapted to be generated. When D1=0, D2=1, D3=0 and D4=0 are set, the middle mid-recording micro-vibrating pulse is adapted to be generated. When D1=1, D2=1, D3=0 and D4=0 are set, the heavy mid-recording micro-vibrating pulse is adapted to be generated. When D1=0, D2=0, D3=0 and D4=0 are set, neither operating pulse nor mid-recording micro-vibrating pulse is adapted to be generated.

The light mid-recording micro-vibrating pulse, the middle mid-recording micro-vibrating pulse and the heavy mid-recording micro-vibrating pulse are generated according to respective temperatures of the ink. That is, if the temperature of the ink is relatively low, the heavy mid-recording micro-vibrating pulse is generated. If the temperature of the ink is relatively not low and not high, the middle mid-recording micro-vibrating pulse is generated. If the temperature of the ink is relatively high, the light mid-recording micro-vibrating pulse is generated. Thus, according to the respective temperatures of the ink, suitable mid-recording controls can be performed.

In the above embodiment, the printer includes the recording head 8 having the bending-mode piezoelectric vibrating members 35. However, the printer may include a recording head 70 having a longitudinal-mode piezoelectric vibrating unit 73, instead of the recording head 8.

As shown in FIG. 10, the recording head 70 has a plastic box-like case 71 defining a housing room 72. The longitudinal-mode piezoelectric vibrating unit 73 has a shape of teeth of a comb, and is inserted in the housing room 72 in such a manner that points of teeth-like portions 73*a* of the piezoelectric vibrating unit 73 are aligned at an opening of the housing room 72. A ink-way unit 74 is bonded on a surface of the case 71 on the side of the opening of the housing room 72. The points of the teeth-like portions 73*a* are fixed at predetermined positions of the ink-way unit 74 to function as piezoelectric vibrating members respectively.

The piezoelectric vibrating unit 73 comprises a plurality of piezoelectric layers 73*b*. As shown in FIG. 10, common inside electrodes 73*c* and individual inside electrodes 73*d* are inserted alternately between each adjacent two of the piezoelectric layers 73*b*. The piezoelectric layers 73*b*, the common inside electrodes 73*c* and the individual inside electrodes 73*d* are integrated and cut into the shape of the teeth of the comb. Thus, when a voltage is provided between the common inside electrodes 73*c* and an individual inside electrode 73*d*, a piezoelectric vibrating member contracts in a longitudinal direction of each of the piezoelectric layers 73*b*.

The ink-way unit 74 consists of a nozzle plate 76, an elastic plate 77 and an ink-way forming plate 75 sandwiched between the nozzle plate 76 and the elastic plate 77. The nozzle plate 76, the ink-way forming plate 75 and the elastic plate 77 are integrated as shown in FIG. 10.

A plurality of nozzles 80 is formed in the nozzle plate 76. A plurality of pressure generating chambers 81, a plurality of ink-supplying ways 82 and a common ink-chamber 83 are formed in the ink-way forming plate 75. Each of the pressure chambers 81 is defined by partition walls, and is communicated with a corresponding nozzle 80 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 81 are formed in the longitudinal direction of the common ink-chamber 83 at the same intervals (pitches) as nozzles 80. Then, a groove as a ink-supplying way 82 is formed between each of the pressure chambers 81 and the common ink-chamber 83. In the case, the ink-supplying way 82 is connected to an end of the pressure chamber 81, while the nozzle 80 is located near the other end of the pressure chamber 81. The common ink-chamber 83 is adapted to supply ink saved in an ink cartridge to the pressure chambers 81. An ink-supplying tube 84 from the ink cartridge is communicated with a middle portion of the common ink-chamber 83.

The elastic plate 77 is layered on a surface of the ink-way forming plate 75 opposed to the nozzle plate 76. In the case, the elastic plate 77 consists of two laminated layers that are a stainless plate 87 and an elastic high-polymer film 88 such as a PPS film. The stainless plate 77 is provided with island portions 89 for fixing the teeth-like portions 73*a* as the piezoelectric vibrating members 73 in respective portions corresponding to the pressure chambers 81, by an etching process.

In the above recording head 70, a teeth-like portion 73*a* as a piezoelectric vibrating member can expand in the longitudinal direction. Then, an island portion 89 is pressed toward the nozzle plate 76, the elastic film 88 is deformed. Thus, a corresponding pressure chamber 81 contracts. On the other hand, the teeth-like portion 73*a* as the piezoelectric vibrating member can contract from the expanding state in the longitudinal direction. Then, the elastic film 88 is returned to the original state owing to elasticity thereof. Thus, the corresponding pressure chamber 81 expands. By causing the pressure chamber 81 to expand and then causing the pressure chamber 81 to contract, a pressure of the ink in the pressure chamber 81 increases so that the ink drop is jetted from a nozzle 80.

In the recording head 70 as well, the menisci can minutely vibrate in such a manner that the ink drop may not be jetted, in order to stir the ink in the nozzles, by expanding and contracting of the piezoelectric vibrating members.

By the way, in the embodiment, the scanning-position-information outputting-information unit consists of the linear encoder 27 and the slit detector 29. In addition, the recording-starting-position-information setting unit, the micro-vibrating-starting-position-information setting unit and the micro-vibrating-starting-timing judging unit are adapted to set or judge the recording-starting-position information, the micro-vibrating-starting-position information and the micro-vibrating-starting-timing by means of the counting value corresponding to the detecting signals outputted from the slit detector 29. In the case, the scanning position of the recording head 8 may be surely obtained.

However, this invention can adopt another scanning-position-information outputting unit. For example, if a pattern of the scanning speed of the recording head 8 is fixed regardless of the dot-pattern-data, that is, if the recording head 8 is moved by the same scanning speed pattern, the scanning position of the recording head 8 can be obtained indirectly from a time passed from when the recording head has started scanning.

In the case, the scanning-position-information outputting unit may consist of a scanning-time timer 101 (first-scanning-time timer) for measuring a time passed from a scanning-starting timing (t1). The scanning position of the recording head 8 can be obtained from a timer value of the scanning-time timer 101, because the timer value corresponds to the head-position information.

In the case, the recording-starting-position-information setting unit may set a timer value for the recording-starting-position, that corresponds to the recording-starting-position information. Similarly, the micro-vibrating-starting-position-information setting unit may set a timer value for the micro-vibrating-starting-position, that corresponds to the micro-vibrating-starting-position information.

The micro-vibrating-starting-timing judging unit judges the micro-vibrating-starting timing by comparing the timer value of the scanning-time timer 101 with the timer value for the micro-vibrating-starting-position. Similarly, the recording-starting-timing judging unit judges the record-starting timing by comparing the timer value of the scanning-time timer 101 with the timer value for the recording-starting-position.

As described above, when the scanning position of the recording head 8 can be obtained from the timer value of the scanning-time timer 101, it is not necessary to provide with the linear encoder 27 and the slit detector 29. Thus, the apparatus may become simpler. In addition, the controlling part 6 does not have to watch the detecting signals from the slit detector 29. Thus, the controlling manner may also become simpler, and the processing speed may become faster.

The scanning-time timer 101 is adapted to measure a time passed from when the recording head 8 has started scanning. However, another scanning-time timer 102 (a second-scanning-time timer) can measure a time passed from when the scanning speed of the recording head 8 has become constant. In the case, a standard-passing position is set at a position where the scanning speed of the recording head 8 should become constant, for example at an end position 18A (see FIG. 7) of the recording paper 18 on the side of the home position HP in the width direction. In addition, there is provided a passing sensor that can detect a passing of the recording head 8 above the standard-passing position. Then, the scanning-time timer 102 starts to measure the time based on a detecting signal of the passing sensor. In the case, since the scanning-time timer 102 starts to measure the time passed from when the scanning speed of the recording head 8 has become constant, the scanning position of the recording head 8 can be obtained more accurately.

However, the scanning-position-information outputting unit is not limited to the combination of the linear encoder 27 and the slit detector 29, the scanning-time timer 101, and the scanning-time timer 102. Any scanning-position-information outputting unit capable of outputting information that represents the scanning position of the recording head 8 may be adopted.

For example, when the carriage 21 is reciprocated in the main scanning direction by a ball-spline mechanism, a rotary encoder may be attached to a rotating shaft of the ball-spline mechanism in such a manner that the rotary encoder rotates together with the rotating shaft, and a slit detector may be provided for detecting slits of the rotary encoder. In the case, the recording-starting-position and the micro-vibrating-starting-position can be recognized from detecting signals from the slit detector.

In the embodiment, the controlling part 6 functioning as a micro-vibrating controlling unit is adapted to supply the operating signal generated by the operating-signal generating part 9 (the main signal generating part 11 and the micro-vibrating-signal generating part 12) to the recording head 8. However, another micro-vibrating controlling unit can be adopted.

In the embodiment, the recording-starting-position-information setting unit is adapted to set the recording-starting-position of the recording head 8 based on the dot-pattern data. However, data for setting the recording-starting-position are not limited to the dot-pattern-data. For example, the recording-starting-position may be set based on printing data (one kind of jetting data) from the host computer, or based on intermediate data (one kind of jetting data).

In the embodiment, the printer includes the recording head 8 having the pressure chambers 36 that can expand and contract by means of the piezoelectric vibrating members 35. However, this invention can also apply to a printer or a plotter including a bubble-jet recording head that can jet ink drop from a nozzle by changing a size of air bubble generated in a pressure chamber.

Figure 11:
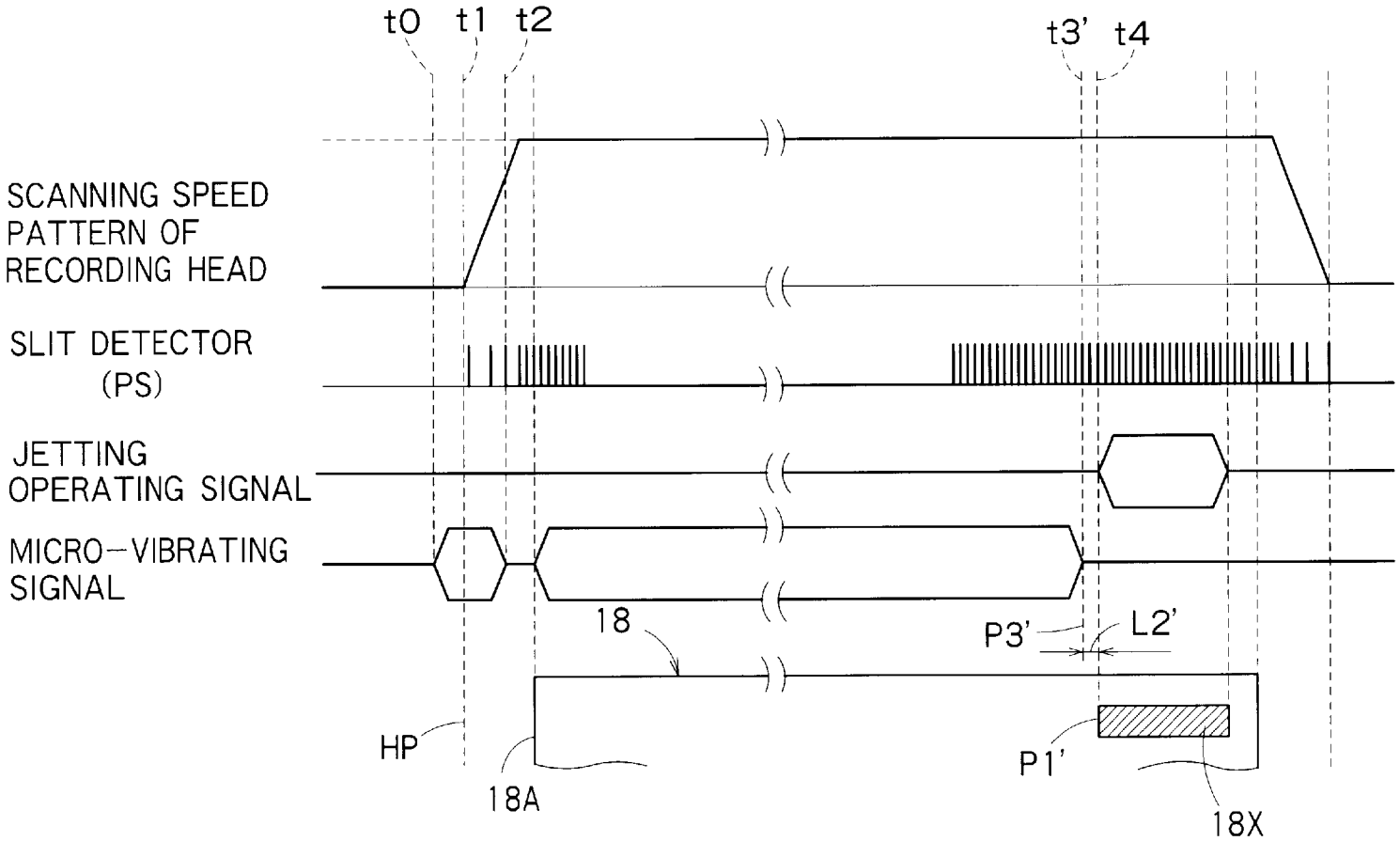
FIG. 11 is another timing chart for explaining a recording operation for a line.

FIG. 11 is another timing chart for explaining a scanning operation including a recording operation for a line. As shown in FIG. 11, the controlling part 6 functions as a micro-vibrating-ceasing-position-information setting unit to set micro-vibrating-ceasing-position information that represents a position where the micro-vibrating unit should cease to cause the ink to minutely vibrate, for example just before starting the recording operation. For example, the micro-vibrating-ceasing-position is set at a position P3' back to the home position HP from the recording-starting-position P1' by a distance L2' that is necessary for the menisci to settle down after minutely vibrating. That is, the setting of the micro-vibrating-ceasing-position P3' is carried out based on the recording-starting-position information that has been set previously. Then, a counting value obtained by subtracting a counting value corresponding to the distance L2' from a counting value corresponding to the recording-starting-position P1' is set as a counting value corresponding to the micro-vibrating-ceasing-position P3'.

In the case shown in FIG. 11, the micro-vibrating-starting-position information is set at an end position 18A of the recording paper 18 on the side of the home position HP in the width direction, regardless of the recording-starting-position information. Of course, the micro-vibrating-starting-position in the case may be set based on the recording-starting-position information.

Figure 6:
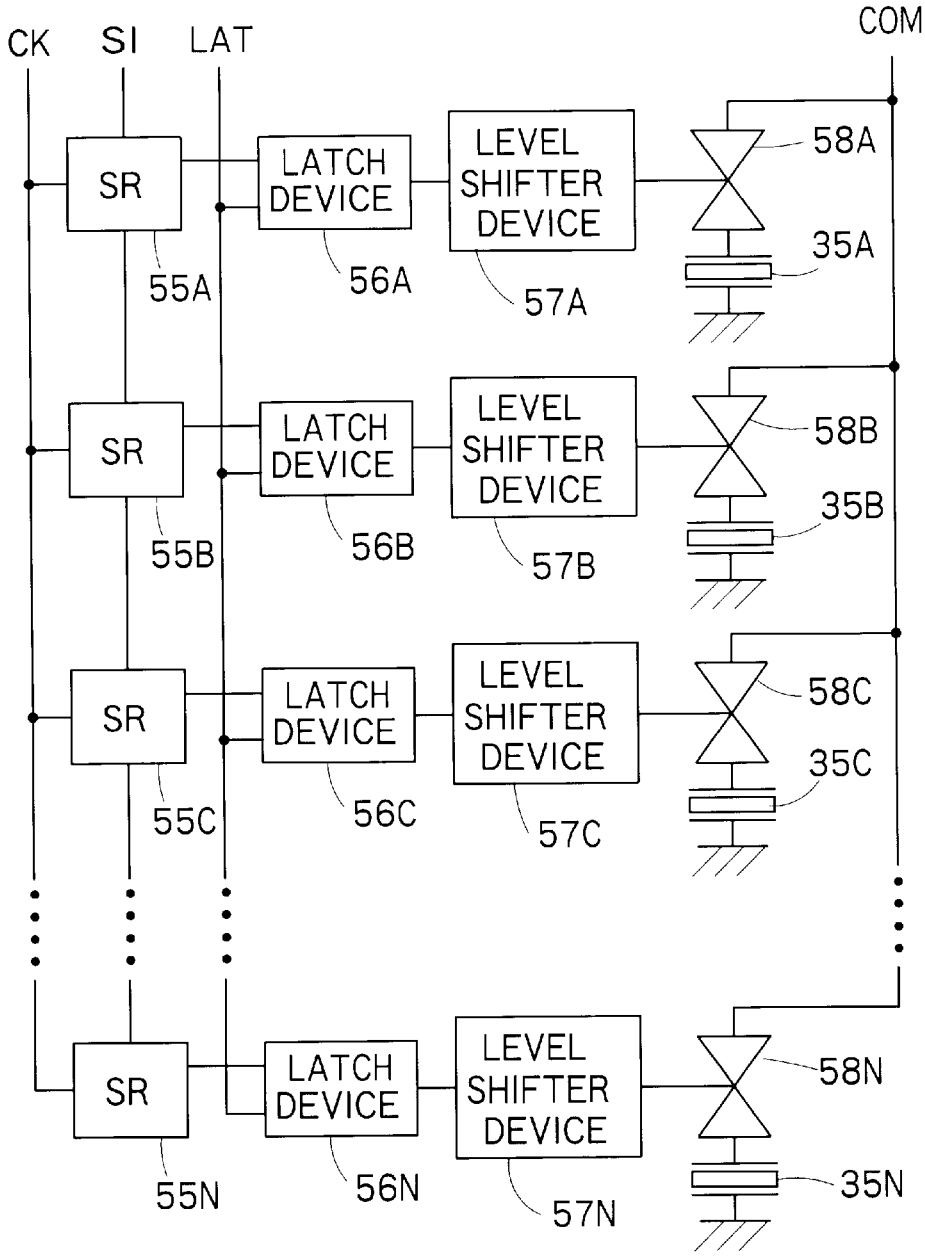
FIG. 6 is a schematic block diagram for explaining an electric structure of the recording head.

When the controlling part 6 judges that it is the pre-recording micro-vibrating-starting timing just before the recording operation, the controlling part 6 functions as a pre-recording micro-vibrating controlling unit (one kind of the micro-vibrating controlling unit) to supply a pre-recording micro-vibrating signal to the piezoelectric vibrating members 35 (S15: see FIG. 9A). That is, the controlling part 6 outputs such a controlling signal to the choosing part 13 that the non-recording common micro-vibrating signal from the micro-vibrating-signal generating part 12 is allowed to be supplied to the piezoelectric vibrating members 35. Then, the controlling part 6 sets the respective bit-data of the mode bit signal in the shift register 55, and outputs the latch signals to the latch circuit 56 to generate the micro-vibrating signal corresponding to the characteristic of increasing viscosity of the ink and supply the micro-vibrating signal to the piezoelectric vibrating members 35 (see FIG. 6). Then, the controlling part 6 supplies an operating pulse to the pulse motor 25 to move the carriage 21 in the main scanning direction. Thus, the recording head 8 starts scanning. If a stopping timing (t3') for the non-recording micro-vibrating signal is judged, the non-recording common micro-vibrating signal stops being supplied from the micro-vibrating-signal generating unit 12. Thus, the non-recording micro-vibrating operations are stopped. In the case, the stopping timing (t3') can be judged by comparing a counting value of the position counter with a predetermined counting value P3'.

As described above, according to the timing chart shown in FIG. 11, the menisci of the ink in the nozzle can be caused to minutely vibrate till a suitable timing (t3') just before an ink drop is jetted from a nozzle. To cause the menisci to keep minutely vibrating till the suitable timing is very effective when the ink consists of pigments whose viscosity is liable to increase.

In the embodiment, the recording-starting-position of the recording head 8 means a position where one of the nozzles of the recording head 8 starts to record, i.e., jet the ink. However, in general, the nozzles start to record at different positions respectively. Thus, it is preferable to take into consideration respective recording-starting-positions of the nozzles.

That is, preferably, the nozzles are classified into at least two classes, the controlling part 6 functioning as a recording-starting-position setting unit is adapted to set recording-starting-position information that represents positions where a nozzle or nozzles of the respective classes should start to record. Then, the controlling part 6 functioning as a micro-vibrating-starting-position setting unit may determine whether to cause the ink in the nozzle or the nozzles of the respective classes to minutely vibrate based on the recording-starting-position information, and may set micro-vibrating-starting-position information that represents respective positions where the micro-vibrating unit should start to cause the ink in the nozzle or the nozzles of the respective classes to minutely vibrate according to the recording-starting-position information if to cause the ink in the nozzle or the nozzles of the respective classes to minutely vibrate is determined. Then, the controlling part 6 functioning as a pre-recording micro-vibrating controlling unit may judge respective micro-vibrating-starting timings for the nozzle or the nozzles of the respective classes according to the micro-vibrating-starting-position information and the head-position information in order to cause the micro-vibrating unit to operate. The micro-vibrating unit may cause ink in the nozzle or nozzles of the respective classes to minutely vibrate.

In the case, when the class may includes a plurality of nozzles, ink in the nozzles of the class has preferably a velocity of increasing viscosity. Alternatively, when the class may includes a plurality of nozzles, ink in the nozzles of the class has a color. Alternatively, when the class may includes a plurality of nozzles, the nozzles of the class are arranged in a row. Alternatively, the class includes only one nozzle.

In the above embodiment, the ink supplied into respective nozzles 51 is common. However, in a case wherein a plurality of kinds of ink is supplied into the respective nozzles 51 such as a case of color printing, the mode bit signal is preferably generated dependently on respective rates of increasing viscosity of the plurality of kinds of ink. Alternatively, the mode bit signal is preferably generated dependently on the respective kinds of ink.

In such a case, by the micro-vibrating mode signal based on the respective mode bit signals and the common micro-vibrating signal, non-recording and/or pre-recording micro-vibrating controls are performed dependently on the respective rates of increasing viscosity of the ink or the respective kinds of the ink. In addition, based on the respective bit-data D1 and D2, mid-recording micro-vibrating controls are performed dependently on the respective rates of increasing viscosity of the ink or the respective kinds of the ink.

In addition, the mode bit signal and/or the upper two bit-data D1 and D2 of the printing data may be generated for a nozzle or nozzles of respective classes, which are divided by a condition other than the kinds of supplied ink. In the case, micro-vibrating controls may be suitably performed for the nozzle or nozzles of the respective classes.

A program for materializing the above element or elements (unit or units) in the computer system, and a storage unit 201 storing the program and capable of being read by a computer, are intended to be protected by this application. When the above element or elements may be materialized in the computer system by using a general program such as an OS, a program including a command or commands for controlling the general program, and a storage unit 202 storing the program and capable of being read by a computer, are also intended to be protected by this application.

The above description is given for the ink-jetting printer 1 as a liquid jetting apparatus of an embodiment according to the invention. However, this invention is intended to apply to general liquid jetting apparatuses widely. For example, the liquid jetting apparatus may be a manufacturing unit for color filters of a display apparatus such as LCD. A liquid may be glue, nail polish, a bonding agent, a hardened coating liquid or the like, instead of the ink.

According to one of the features, since the micro-vibrating controlling unit can cause the micro-vibrating unit to operate based on the common micro-vibrating signal and the micro-vibrating mode signal, even if the common micro-vibrating signal is used, micro-vibrating operations suitable for the liquid can be achieved by generating the micro-vibrating mode signal dependently on the liquid.

Especially when the micro-vibrating controlling unit may have: a signal fusing part that can generate a micro-vibrating operating signal being an AND signal of the common micro-vibrating signal and the micro-vibrating mode signal, and a main controlling part that can cause the micro-vibrating unit to operate based on the micro-vibrating operating signal, a signal processing based on the common micro-vibrating signal and the micro-vibrating mode signal can be achieved more easily.

In addition, if the common micro-vibrating signal is a periodical signal of a period including a predetermined waveform, and the micro-vibrating mode signal is a periodical signal of a same period as the common micro-vibrating signal including a or more predetermined rectangular pulses, the respective signals can be generated more easily.

According to one of the features, since the main mode signal is generated based on the liquid supplied to the nozzle and the operating signal is formed by an AND signal of the jetting-operating signal and the main mode signal, mid-jetting micro-vibrating operations can be suitably achieved correspondingly to respective characteristics, kinds or states of the liquid.

According to one of the features, since the respective main mode signals are generated based on the liquid supplied to the nozzle or nozzles of the respective classes, mid-jetting micro-vibrating operations can be suitably achieved correspondingly to nozzle or nozzles of the respective classes.

What is claimed is:

1. A liquid jetting apparatus comprising;

a head member having a nozzle, a micro-vibrating unit that can cause liquid in the nozzle to minutely vibrate, a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

2. A liquid jetting apparatus according to claim 1, wherein:

the serial-signal generating unit is a micro-vibrating-signal generating unit that can generate a common micro-vibrating signal being a serial periodical signal, the mode-signal generating unit is a micro-vibrating-mode-signal generating unit that can generate a micro-vibrating mode signal depending on the liquid supplied to the nozzle, and the micro-vibrating controlling unit is adapted to cause the micro-vibrating unit to operate, based on the common micro-vibrating signal and the micro-vibrating mode signal.

3. A liquid jetting apparatus according to claim 2, wherein:

the micro-vibrating-mode-signal generating unit is adapted to generate a micro-vibrating mode signal depending on a rate of increasing viscosity of the liquid supplied to the nozzle.

4. A liquid jetting apparatus according to claim 2, wherein:

the micro-vibrating-mode-signal generating unit is adapted to generate a micro-vibrating mode signal depending on temperature of the liquid supplied to the nozzle.

5. A liquid jetting apparatus according to claim 2, wherein:

the micro-vibrating controlling unit has:

a signal fusing part that can generate a micro-vibrating operating signal being an AND signal of the common micro-vibrating signal and the micro-vibrating mode signal, and a main controlling part that can cause the micro-vibrating unit to operate based on the micro-vibrating operating signal.

6. A liquid jetting apparatus according to claim 5, wherein:

the common micro-vibrating signal is a periodical signal of a period including a predetermined waveform, and the micro-vibrating mode signal is a periodical signal of a same period as the common micro-vibrating signal including a or more predetermined rectangular pulses.

7. A liquid jetting apparatus according to claim 6, wherein:

the common micro-vibrating signal is a periodical signal of a period including a middle trapezoidal pulse and a large trapezoidal pulse, which appear at substantially regular intervals.

8. A liquid jetting apparatus according to claim 2, wherein:

the micro-vibrating-signal generating unit has:

a temperature-detecting part that can detect temperature of the head member, a signal-determining part that can determine an amplitude and a waveform of the common micro-vibrating signal, based on the temperature of the head member detected by the temperature-detecting part, and a signal-generating part that can generate the common micro-vibrating signal determined by the signal-determining part.

9. A liquid jetting apparatus according to claim 1, wherein:

the serial-signal generating unit is a main-signal generating unit that can generate a jetting-operating signal being a serial periodical signal, the mode-signal generating unit is a main-mode-signal generating unit that can generate a main mode signal depending on jetting data and the liquid supplied to the nozzle, a pressure-changing unit that can change a pressure of the liquid in the nozzle is provided, a signal fusing part that can generate an operating-pulse signal being an AND signal of the jetting-operating signal and the main mode signal is provided, a main controlling part that can cause the pressure-changing unit to operate based on the operating-pulse signal is provided, the jetting-operating signal is a periodical signal of a period including at least two trapezoidal pulses for performing mid-jetting micro-vibrating operations and at least one waveform for jetting a drop of the liquid, and the main mode signal is a periodical signal of a same period as the jetting-operating signal including a or more predetermined rectangular pulses.

10. A liquid jetting apparatus according to claim 9, wherein:

the main-mode-signal generating unit is adapted to generate a micro-vibrating mode signal depending on a rate of increasing viscosity of the liquid supplied to the nozzle.

11. A liquid jetting apparatus according to claim 9, wherein:

the main-mode-signal generating unit is adapted to generate a micro-vibrating mode signal depending on temperature of the liquid supplied to the nozzle.

12. A liquid jetting apparatus according to claim 9, wherein:

the at least two trapezoidal pulses for performing the mid-jetting micro-vibrating operations include a middle trapezoidal pulse and a large trapezoidal pulse.

13. A liquid jetting apparatus according to claim 9, wherein:

the main-signal generating unit has:

a temperature-detecting part that can detect temperature of the head member, a signal-determining part that can determine an amplitude and a waveform of the jetting-operating signal, based on the temperature of the head member detected by the temperature-detecting part, and a signal-generating part that can generate the jetting-operating signal determined by the signal-determining part.

14. A liquid jetting apparatus according to claim 1, wherein:

a head member having a plurality of nozzles, the nozzles being classified into at least first and second classes, a pressure-changing unit that can change a pressure of liquid in a nozzle or nozzles of the first class and that can change a pressure of liquid in a nozzle or nozzles of the second class, a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

15. A liquid jetting apparatus according to claim 14, wherein:

at least one of the classes includes a plurality of nozzles, and liquid in the nozzles of the at least one of the classes has a rate of increasing viscosity.

16. A liquid jetting apparatus according to claim 14, wherein:

at least one of the classes includes a plurality of nozzles, and liquid in the nozzles of the at least one of the classes is a same kind.

17. A liquid jetting apparatus according to claim 14, wherein:

the at least two trapezoidal pulses for performing the mid-jetting micro-vibrating operations include a middle trapezoidal pulse and a large trapezoidal pulse.

18. A liquid jetting apparatus according to claim 14, wherein:

the main-signal generating unit has:

a temperature-detecting part that can detect temperature of the head member, a signal-determining part that can determine an amplitude and a waveform of the jetting-operating signal, based on the temperature of the head member detected by the temperature-detecting part, and a signal-generating part that can generate the jetting-operating signal determined by the signal-determining part.

19. A liquid jetting apparatus according to claim 1, wherein:

the liquid is ink, and the head member is a recording head.

20. A liquid jetting apparatus comprising:

a head member having a plurality of nozzles, the nozzles being classified into at least first and second classes, a micro-vibrating unit that can cause liquid in a nozzle or nozzles of the first class to minutely vibrate and that can cause liquid in a nozzle or nozzles of the second class to minutely vibrate, a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

21. A liquid jetting apparatus according to claim 20, wherein:

the micro-vibrating-mode-signal generating unit is adapted to generate the respective micro-vibrating mode signals depending on respective rates of increasing viscosity of liquid supplied to the nozzle or nozzles of the respective classes.

22. A liquid jetting apparatus according to claim 20, wherein:

the micro-vibrating-mode-signal generating unit is adapted to generate the respective micro-vibrating mode signal depending on respective temperatures of liquid supplied to the nozzle or nozzles of the respective classes.

23. A liquid jetting apparatus according to claim 20, wherein:

at least one of the classes includes a plurality of nozzles, and liquid in the nozzles of the at least one of the classes has a rate of increasing viscosity.

24. A liquid jetting apparatus according to claim 20, wherein:

at least one of the classes includes a plurality of nozzles, and liquid in the nozzles of the at least one of the classes is a same kind.

25. A liquid jetting apparatus according to claim 20, wherein:

the micro-vibrating controlling unit has:

a signal fusing part that can generate respective micro-vibrating operating signals being AND signals of the common micro-vibrating signal and the respective micro-vibrating mode signals, and a main controlling part that can cause the micro-vibrating unit to operate based on the respective micro-vibrating operating signals.

26. A liquid jetting apparatus according to claim 25, wherein:

the common micro-vibrating signal is a periodical signal of a period including a predetermined waveform, and each micro-vibrating mode signal is a periodical signal of a same period as the common micro-vibrating signal including a or more predetermined rectangular pulses.

27. A liquid jetting apparatus according to claim 26, wherein:

the common micro-vibrating signal is a periodical signal of a period including a middle trapezoidal pulse and a large trapezoidal pulse, which appear at substantially regular intervals.

28. A liquid jetting apparatus according to claim 20, wherein:

the micro-vibrating-signal generating unit has:

a temperature-detecting part that can detect temperature of the head member, a signal-determining part that can determine an amplitude and a waveform of the common micro-vibrating signal, based on the temperature of the head member detected by the temperature-detecting part, and a signal-generating part that can generate the common micro-vibrating signal determined by the signal-determining part.

29. A controlling unit for controlling a liquid jetting apparatus including: a head having a nozzle; and a micro-vibrating unit that can cause liquid in the nozzle to minutely vibrate; the controlling unit comprising:

a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

30. A controlling unit according to claim 29, wherein:

the serial-signal generating unit is a micro-vibrating-signal generating unit that can generate a common micro-vibrating signal being a serial periodical signal, the mode-signal generating unit is a micro-vibrating-mode-signal generating unit that can generate a micro-vibrating mode signal depending on the liquid supplied to the nozzle, and the micro-vibrating controlling unit is adapted to cause the micro-vibrating unit to operate, based on the common micro-vibrating signal and the micro-vibrating mode signal.

31. A controlling unit according to claim 30, wherein:

the micro-vibrating-mode-signal generating unit is adapted to generate a micro-vibrating mode signal depending on a rate of increasing viscosity of the liquid supplied to the nozzle.

32. A controlling unit according to claim 30, wherein:

the micro-vibrating-mode-signal generating unit is adapted to generate a micro-vibrating mode signal depending on temperature of the liquid supplied to the nozzle.

33. A controlling unit according to claim 30, wherein:

the micro-vibrating controlling unit has:

a signal fusing part that can generate a micro-vibrating operating signal being an AND signal of the common micro-vibrating signal and the micro-vibrating mode signal, and a main controlling part that can cause the micro-vibrating unit to operate based on the micro-vibrating operating signal.

34. A controlling unit according to claim 33, wherein:

the common micro-vibrating signal is a periodical signal of a period including a predetermined waveform, and the micro-vibrating mode signal is a periodical signal of a same period as the common micro-vibrating signal including a or more predetermined rectangular pulses.

35. A controlling unit according to claim 34, wherein:

the common micro-vibrating signal is a periodical signal of a period including a middle trapezoidal pulse and a large trapezoidal pulse, which appear at substantially regular intervals.

36. A controlling unit according to claim 29, wherein:

the micro-vibrating-signal generating unit has:

a temperature-detecting part that can detect temperature of the head member, a signal-determining part that can determine an amplitude and a waveform of the common micro-vibrating signal, based on the temperature of the head member detected by the temperature-detecting part, and a signal-generating part that can generate the common micro-vibrating signal determined by the signal-determining part.

37. A controlling unit according to claim 29, wherein:

the serial-signal generating unit is a main-signal generating unit that can generate a jetting-operating signal being a serial periodical signal, the mode-signal generating unit is a main-mode-signal generating unit that can generate a main mode signal depending on jetting data and the liquid supplied to the nozzle, a signal fusing part that can generate an operating-pulse signal being an AND signal of the jetting-operating signal and the main mode signal is provided, a main controlling part that can cause a pressure-changing unit included in the liquid jetting apparatus, which can change a pressure of the liquid in the nozzle, to operate based on the operating-pulse signal is provided, the jetting-operating signal is a periodical signal of a period including at least two trapezoidal pulses for performing mid-jetting micro-vibrating operations and at least one waveform for jetting a drop of the liquid, and the main mode signal is a periodical signal of a same period as the jetting-operating signal including a or more predetermined rectangular pulses.

38. A controlling unit according to claim 37, wherein:

the main-mode-signal generating unit is adapted to generate a micro-vibrating mode signal depending on a rate of increasing viscosity of the liquid supplied to the nozzle.

39. A controlling unit according to claim 37, wherein:

the main-mode-signal generating unit is adapted to generate a micro-vibrating mode signal depending on temperature of the liquid supplied to the nozzle.

40. A controlling unit according to claim 37, wherein:

the at least two trapezoidal pulses for performing the mid-jetting micro-vibrating operations include a middle trapezoidal pulse and a large trapezoidal pulse.

41. A controlling unit according to claim 37, wherein:

the main-signal generating unit has:

a temperature-detecting part that can detect temperature of the head member, a signal-determining part that can determine an amplitude and a waveform of the jetting-operating signal, based on the temperature of the head member detected by the temperature-detecting part, and a signal-generating part that can generate the jetting-operating signal determined by the signal-determining part.

42. A controlling unit according to claim 30, wherein:

the micro-vibrating-signal generating unit has:

a temperature-detecting part that can detect temperature of the head member, a signal-determining part that can determine an amplitude and a waveform of the common micro-vibrating signal, based on the temperature of the head member detected by the temperature-detecting part, and a signal-generating part that can generate the common micro-vibrating signal determined by the signal-determining part.

43. A controlling unit for controlling a liquid jetting apparatus including: a head member having a plurality of nozzles, the nozzles being classified into at least first and second classes; and a micro-vibrating unit that can cause liquid in a nozzle or nozzles of the first class to minutely vibrate and that can cause liquid in a nozzle or nozzles of the second class to minutely vibrate; the controlling unit comprising:

a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

44. A controlling unit according to claim 43, wherein:

the micro-vibrating-mode-signal generating unit is adapted to generate the respective micro-vibrating mode signals depending on respective rates of increasing viscosity of liquid supplied to the nozzle or nozzles of the respective classes.

45. A controlling unit according to claim 43, wherein:

the micro-vibrating-mode-signal generating unit is adapted to generate the respective micro-vibrating mode signal depending on respective temperatures of liquid supplied to the nozzle or nozzles of the respective classes.

46. A controlling unit according to claim 43, wherein:

at least one of the classes includes a plurality of nozzles, and liquid in the nozzles of the at least one of the classes has a rate of increasing viscosity.

47. A controlling unit according to claim 43, wherein:

at least one of the classes includes a plurality of nozzles, and liquid in the nozzles of the at least one of the classes is a same kind.

48. A controlling unit according to claim 43, wherein:

the micro-vibrating controlling unit has:

a signal fusing part that can generate respective micro-vibrating operating signals being AND signals of the common micro-vibrating signal and the respective micro-vibrating mode signals, and a main controlling part that can cause the micro-vibrating unit to operate based on the respective micro-vibrating operating signals.

49. A controlling unit according to claim 48, wherein:

the common micro-vibrating signal is a periodical signal of a period including a predetermined waveform, and each micro-vibrating mode signal is a periodical signal of a same period as the common micro-vibrating signal including a or more predetermined rectangular pulses.

50. A controlling unit according to claim 49, wherein:

the common micro-vibrating signal is a periodical signal of a period including a middle trapezoidal pulse and a large trapezoidal pulse, which appear at substantially regular intervals.

51. A controlling unit for controlling a liquid jetting apparatus including: a head member having a plurality of nozzles, the nozzles being classified into at least first and second classes; and a pressure-changing unit that can change a pressure of liquid in a nozzle or nozzles of the first class and that can change a pressure of liquid in a nozzle or nozzles of the second class; the controlling unit comprising:

a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, wherein the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

52. A controlling unit according to claim 51, wherein:

at least one of the classes includes a plurality of nozzles, and liquid in the nozzles of the at least one of the classes has a rate of increasing viscosity.

53. A controlling unit according to claim 51, wherein:

at least one of the classes includes a plurality of nozzles, and liquid in the nozzles of the at least one of the classes is a same kind.

54. A controlling unit according to claim 51, wherein:

the at least two trapezoidal pulses for performing the mid-jetting micro-vibrating operations include a middle trapezoidal pulse and a large trapezoidal pulse.

55. A controlling unit according to claim 51, wherein:

the main-signal generating unit has:

a temperature-detecting part that can detect temperature of the head member, a signal-determining part that can determine an amplitude and a waveform of the jetting-operating signal, based on the temperature of the head member detected by the temperature-detecting part, and a signal-generating part that can generate the jetting-operating signal determined by the signal-determining part.

56. A storage unit capable of being read by a computer, storing a program for materializing a controlling unit that can control a liquid jetting apparatus including: a head having a nozzle; and a micro-vibrating unit that can cause liquid in the nozzle to minutely vibrate; the controlling unit comprising:

a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

57. A storage unit capable of being read by a computer, storing a program for materializing a controlling unit that can control a liquid jetting apparatus including: a head member having a plurality of nozzles, the nozzles being classified into at least first and second classes; and a micro-vibrating unit that can cause liquid in a nozzle or nozzles of the first class to minutely vibrate and that can cause liquid in a nozzle or nozzles of the second class to minutely vibrate; the controlling unit comprising:

a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

58. A storage unit capable of being read by a computer, storing a program for materializing a controlling unit that can control a liquid jetting apparatus including: a head member having a plurality of nozzles, the nozzles being classified into at least first and second classes; and a pressure-changing unit that can change a pressure of liquid in a nozzle or nozzles of the first class and that can change a pressure of liquid in a nozzle or nozzles of the second class; the controlling unit comprising:

a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, wherein the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

59. A storage unit capable of being read by a computer, storing a program including a command for controlling a second program executed by a computer system including a computer, the program is executed by the computer system to control the second program to materialize a controlling unit that can control a liquid jetting apparatus including: a head having a nozzle; and a micro-vibrating unit that can cause liquid in the nozzle to minutely vibrate; the controlling unit comprising:

a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

60. A storage unit capable of being read by a computer, storing a program including a command for controlling a second program executed by a computer system including a computer, the program is executed by the computer system to control the second program to materialize a controlling unit that can control a liquid jetting apparatus including: a head member having a plurality of nozzles, the nozzles being classified into at least first and second classes; and a micro-vibrating unit that can cause liquid in a nozzle or nozzles of the first class to minutely vibrate and that can cause liquid in a nozzle or nozzles of the second class to minutely vibrate; the controlling unit comprising:

a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

61. A storage unit capable of being read by a computer, storing a program including a command for controlling a second program executed by a computer system including a computer, the program is executed by the computer system to control the second program to materialize a controlling unit that can control a liquid jetting apparatus including: a head member having a plurality of nozzles, the nozzles being classified into at least first and second classes; and a pressure-changing unit that can change a pressure of liquid in a nozzle or nozzles of the first class and that can change a pressure of liquid in a nozzle or nozzles of the second class; the controlling unit comprising:

a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, wherein the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

62. A program for materializing a controlling unit that can control a liquid jetting apparatus including: a head having a nozzle; and a micro-vibrating unit that can cause liquid in the nozzle to minutely vibrate; the controlling unit comprising:

a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

63. A program for materializing a controlling unit that can control a liquid jetting apparatus including: a head member having a plurality of nozzles, the nozzles being classified into at least first and second classes; and a micro-vibrating unit that can cause liquid in a nozzle or nozzles of the first class to minutely vibrate and that can cause liquid in a nozzle or nozzles of the second class to minutely vibrate; the controlling unit comprising:

a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

64. A program for materializing a controlling unit that can control a liquid jetting apparatus including: a head member having a plurality of nozzles, the nozzles being classified into at least first and second classes; and a pressure-changing unit that can change a pressure of liquid in a nozzle or nozzles of the first class and that can change a pressure of liquid in a nozzle or nozzles of the second class; the controlling unit comprising:

a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, wherein the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

65. A program including a command for controlling a second program executed by a computer system including a computer, the program is executed by the computer system to control the second program to materialize a controlling unit that can control a liquid jetting apparatus including: a head having a nozzle; and a micro-vibrating unit that can cause liquid in the nozzle to minutely vibrate; the controlling unit comprising:

a serial-signal generating unit that can generate a serial periodical signal, a mode-signal generating unit that can generate a mode signal depending on the liquid supplied to the nozzle, and a micro-vibrating controlling unit that can cause the micro-vibrating unit to operate, based on the serial periodical signal and the mode signal.

66. A program including a command for controlling a second program executed by a computer system including a computer, the program is executed by the computer system to control the second program to materialize a controlling unit that can control a liquid jetting apparatus including: a head member having a plurality of nozzles, the nozzles being classified into at least first and second classes; and a micro-vibrating unit that can cause liquid in a nozzle or nozzles of the first class to minutely vibrate and that can cause liquid in a nozzle or nozzles of the second class to minutely vibrate; the controlling unit comprising:

a micro-vibrating-signal generating unit that can generate a common micro-vibrating signal, a micro-vibrating-mode-signal generating unit that can generate a first micro-vibrating mode signal depending on the nozzle or nozzles of the first class and that can generate a second micro-vibrating mode signal depending on the nozzle or nozzles of the second class, and a micro-vibrating controlling unit that can cause the micro-vibrating unit to operate, based on the common micro-vibrating signal and the respective micro-vibrating mode signals.

67. A program including a command for controlling a second program executed by a computer system including a computer, the program is executed by the computer system to control the second program to materialize a controlling unit that can control a liquid jetting apparatus including: a head member having a plurality of nozzles, the nozzles being classified into at least first and second classes; and a pressure-changing unit that can change a pressure of liquid in a nozzle or nozzles of the first class and that can change a pressure of liquid in a nozzle or nozzles of the second class; the controlling unit comprising:

a main-signal generating unit that can generate a jetting-operating signal, a main-mode-signal generating unit that can generate a first main mode signal depending on jetting data and the liquid supplied to the nozzle or nozzles of the first class and that can generate a second main mode signal depending on jetting data and the liquid supplied to the nozzle or nozzles of the second class, a signal fusing part that can generate respective operating-pulse signals being AND signals of the jetting-operating signal and the respective main mode signals, and a main controlling part that can cause the pressure-changing unit to operate based on the respective operating-pulse signals, wherein the jetting-operating signal is a periodical signal of a period including at least two trapezoidal pulses for performing mid-jetting micro-vibrating operations and at least one waveform for jetting a drop of the liquid, and each main mode signal is a periodical signal of a same period as the jetting-operating signal including a or more predetermined rectangular pulses.

* * * * *